US010371382B2

(12) United States Patent
Corsmeier

(10) Patent No.: US 10,371,382 B2
(45) Date of Patent: Aug. 6, 2019

(54) COMBUSTOR HEAT SHIELD AND ATTACHMENT FEATURES

(71) Applicant: General Electric Company, Schenectady, NY (US)

(72) Inventor: Donald Michael Corsmeier, West Chester, OH (US)

(73) Assignee: General Electric Company, Schenectady, NY (US)

( * ) Notice: Subject to any disclaimer, the term of this patent is extended or adjusted under 35 U.S.C. 154(b) by 323 days.

(21) Appl. No.: 15/281,698

(22) Filed: Sep. 30, 2016

(65) Prior Publication Data

US 2018/0094813 A1 Apr. 5, 2018

(51) Int. Cl.
*F23R 3/60* (2006.01)
*F23R 3/00* (2006.01)

(52) U.S. Cl.
CPC ..... *F23R 3/002* (2013.01); *F23R 3/007* (2013.01); *F23R 3/60* (2013.01); *F23R 2900/00012* (2013.01)

(58) Field of Classification Search
CPC .. F23R 3/002; F23R 3/007; F23R 3/60; F23R 2900/00018
See application file for complete search history.

(56) References Cited

U.S. PATENT DOCUMENTS 4,454,711 A * 6/1984 Ben-Porat ..... F23R 3/10 60/748
5,419,115 A * 5/1995 Butler ..... F23R 3/10 60/740
7,464,554 B2 12/2008 Cheung et al.
7,966,832 B1 * 6/2011 Lockyer ..... F23R 3/002 60/755
8,756,935 B2 6/2014 Duval et al.
8,763,406 B2 7/2014 Pieussergues et al.
8,943,835 B2 2/2015 Corsmeier et al.
2010/0194179 A1 8/2010 Waltz
2011/0271684 A1 11/2011 Corsmeier et al.
2014/0026580 A1 1/2014 Pardington et al.
2015/0107109 A1 4/2015 Corsmeier et al.
2015/0260404 A1 9/2015 Sullivan

FOREIGN PATENT DOCUMENTS

FR 2825778 A1 12/2002
FR 2935465 A1 3/2010

* cited by examiner

*Primary Examiner* — Steven M Sutherland
(74) *Attorney, Agent, or Firm* — Dority & Manning, P.A.

(57) ABSTRACT

Combustor assemblies having heat shields and features for attaching the heat shields are provided. For example, a combustor assembly includes a combustor dome defining an aperture, and a heat shield defining an opening and including a cup extending about the opening that extends toward the aperture of the combustor dome. The combustor assembly also includes a collar comprising a first piece and a second piece that each surround a portion of the heat shield cup. The collar may include a first arm, a second arm, and a body connecting the first and second arms such that the collar defines a recess between the first and second arms. The combustor assembly also may include an attachment piece with a flange that is positioned in the recess with a heat shield flange; the attachment piece attaches to the combustor dome to couple the heat shield and the combustor dome.

17 Claims, 14 Drawing Sheets

COMBUSTOR HEAT SHIELD AND ATTACHMENT FEATURES

FIELD OF THE INVENTION

The present subject matter relates generally to combustor assemblies of gas turbine engines. More particularly, the present subject matter relates to heat shields for combustors of gas turbine engines and features for attaching heat shields to combustor assemblies.

BACKGROUND OF THE INVENTION

A gas turbine engine generally includes a fan and a core arranged in flow communication with one another. Additionally, the core of the gas turbine engine generally includes, in serial flow order, a compressor section, a combustion section, a turbine section, and an exhaust section. In operation, air is provided from the fan to an inlet of the compressor section where one or more axial compressors progressively compress the air until it reaches the combustion section. Fuel is mixed with the compressed air and burned within the combustion section to provide combustion gases. The combustion gases are routed from the combustion section to the turbine section. The flow of combustion gases through the turbine section drives the turbine section and is then routed through the exhaust section, e.g., to atmosphere.

Combustion gas temperatures are relatively hot, such that some components in or near the combustion section and the downstream turbine section require features for deflecting or mitigating the effects of the combustion gas temperatures. For example, one or more heat shields may be provided on a combustor dome to help protect the dome from the heat of the combustion gases. However, such heat shields often require cooling themselves, e.g., through a flow of cooling fluid directed against the heat shields, which can negatively impact turbine emissions. Further, turbine performance and efficiency generally may be improved by increasing combustion gas temperatures. Therefore, there is an interest in providing heat shields that can withstand increased combustion gas temperatures yet also require less cooling, to increase turbine performance and efficiency while also reducing turbine emissions.

Non-traditional high temperature materials, such as ceramic matrix composite (CMC) materials, are more commonly being used for various components within gas turbine engines. For example, because CMC materials can withstand relatively extreme temperatures, there is particular interest in replacing components within the flow path of the combustion gases, such as combustor dome heat shields, with CMC materials. Nonetheless, typical CMC heat shields have complex shapes that are difficult to fabricate, often requiring complex or special tooling, and are difficult to assemble with the combustor dome, usually requiring numerous intricate metal pieces to properly assemble the heat shields with the dome.

Accordingly, improved combustor heat shields and features for attaching heat shields within combustor assemblies that overcome one or more disadvantages of existing designs would be desirable. In particular, a combustor assembly utilizing a CMC heat shield would be helpful. Additionally, a combustor assembly with one or more features for fastening a CMC heat shield to a combustor dome that compensates for any difference in thermal expansion between the CMC heat shield and the combustor dome would be beneficial. Moreover, a combustor assembly with one or more features for minimizing rotation of a heat shield with respect to a combustor dome would be useful. Further, a combustor assembly with one or more features providing sealing between a heat shield and a combustor dome would be beneficial. Improved methods of fabricating a CMC heat shield also would be advantageous.

BRIEF DESCRIPTION OF THE INVENTION

Aspects and advantages of the invention will be set forth in part in the following description, or may be obvious from the description, or may be learned through practice of the invention.

In one exemplary embodiment of the present disclosure, a combustor assembly for a gas turbine engine is provided. The combustor assembly includes a combustor dome defining an aperture, and a heat shield defining an opening and including a cup extending about the opening. The cup extends toward the aperture of the combustor dome. The combustor assembly also includes a collar comprising a first piece and a second piece. Each piece of the collar surrounds a portion of the heat shield cup.

In another exemplary embodiment of the present disclosure, a combustor assembly for a gas turbine engine is provided. The combustor assembly includes a combustor dome defining an aperture, and a heat shield defining an opening and including a cup extending about the opening. The cup extends toward the aperture of the combustor dome, and the heat shield also includes a heat shield flange that extends outwardly from an outer perimeter of the cup. The combustor assembly further comprises a collar including a first arm, a second arm, and a body connecting the first arm and the second arm such that the collar defines a recess between the first arm and the second arm. The heat shield flange is positioned within the recess.

In a further exemplary embodiment of the present disclosure, a combustor assembly for a gas turbine engine is provided. The combustor assembly includes a combustor dome defining an aperture, and a heat shield defining an opening and including a cup extending about the opening. The cup extends toward the aperture of the combustor dome, and the heat shield also includes a heat shield flange extending outwardly from an outer perimeter of the cup. The combustor assembly further includes an attachment piece defining an opening therethrough. The attachment piece includes an attachment flange extending outwardly from an outer perimeter of the attachment piece. The combustor assembly also comprises a collar surrounding the heat shield flange and the attachment flange to couple the heat shield and the attachment piece. The attachment piece attaches to the combustor dome to couple the heat shield and the combustor dome.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
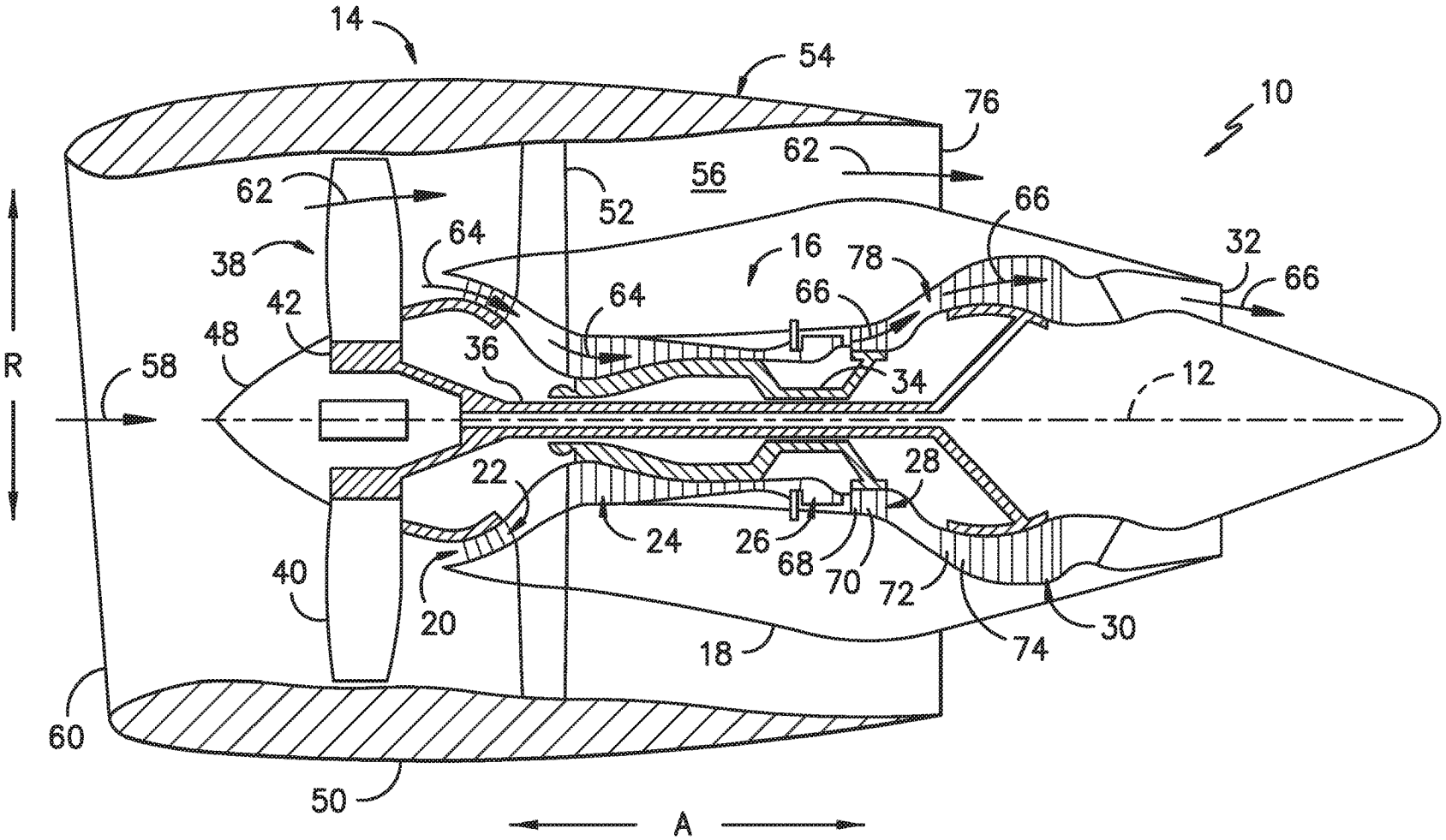
FIG. 1 provides a schematic cross-section view of an exemplary gas turbine engine according to various embodiments of the present subject matter.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows and "downstream" refers to the direction to which the fluid flows.

Referring now to the drawings, wherein identical numerals indicate the same elements throughout the figures, FIG. 1 is a schematic cross-sectional view of a gas turbine engine in accordance with an exemplary embodiment of the present disclosure. More particularly, for the embodiment of FIG. 1, the gas turbine engine is a high-bypass turbofan jet engine 10, referred to herein as "turbofan engine 10." As shown in FIG. 1, the turbofan engine 10 defines an axial direction A (extending parallel to a longitudinal centerline 12 provided for reference) and a radial direction R. In general, the turbofan 10 includes a fan section 14 and a core turbine engine 16 disposed downstream from the fan section 14.

The exemplary core turbine engine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22.

For the depicted embodiment, fan section 14 includes a fan 38 having a plurality of fan blades 40 coupled to a disk 42 in a spaced apart manner. As depicted, fan blades 40 extend outward from disk 42 generally along the radial direction R. The fan blades 40 and disk 42 are together rotatable about the longitudinal axis 12 by LP shaft 36. In some embodiments, a power gear box having a plurality of gears may be included for stepping down the rotational speed of the LP shaft 36 to a more efficient rotational fan speed.

Referring still to the exemplary embodiment of FIG. 1, disk 42 is covered by rotatable front nacelle 48 aerodynamically contoured to promote an airflow through the plurality of fan blades 40. Additionally, the exemplary fan section 14 includes an annular fan casing or outer nacelle 50 that circumferentially surrounds the fan 38 and/or at least a portion of the core turbine engine 16. It should be appreciated that nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass airflow passage 56 therebetween.

During operation of the turbofan engine 10, a volume of air 58 enters turbofan 10 through an associated inlet 60 of the nacelle 50 and/or fan section 14. As the volume of air 58 passes across fan blades 40, a first portion of the air 58 as indicated by arrows 62 is directed or routed into the bypass airflow passage 56 and a second portion of the air 58 as indicated by arrows 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft or spool 34, thus causing the HP shaft or spool 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft or spool 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core turbine engine 16.

Figure 2:
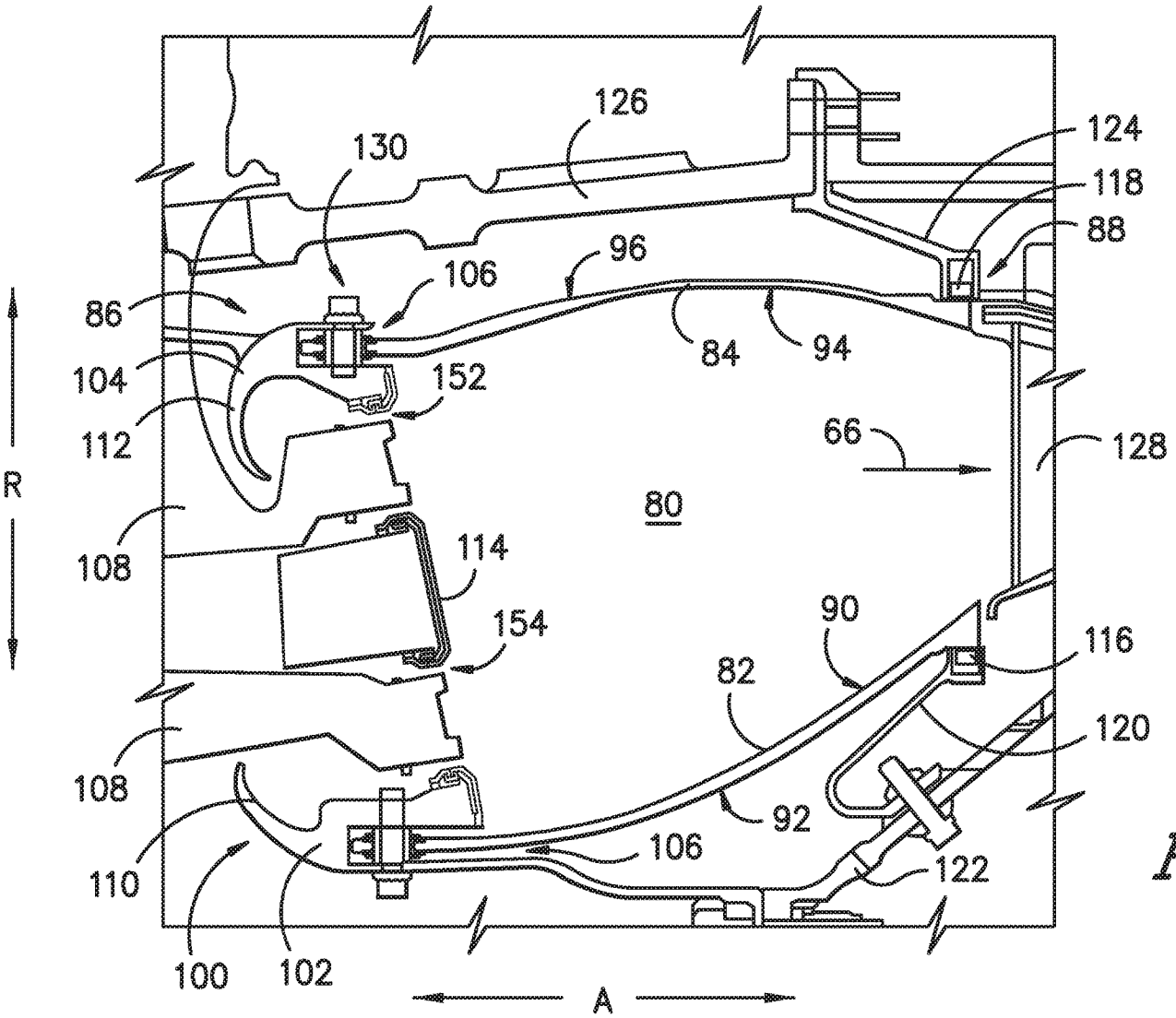
FIG. 2 provides a schematic cross-section view of a combustor assembly according to an exemplary embodiment of the present subject matter.

Referring now to FIG. 2, a schematic, cross-sectional view is provided of a combustor assembly 79 according to an exemplary embodiment of the present subject matter. More particularly, FIG. 2 provides a side, cross-sectional view of an exemplary combustor assembly 79, which may, for example, be positioned in the combustion section 26 of the exemplary turbofan engine 12 of FIG. 1.

Combustor assembly 79 depicted in FIG. 2 generally includes a combustion chamber 80 defined by an inner liner 82 and an outer liner 84, e.g., combustion liners 82, 84 together at least partially define combustion chamber 80 therebetween. Combustion liners 82, 84, or other components of combustor assembly 79, may be made from a ceramic matrix composite (CMC) material as further described below. Combustor assembly 79 extends generally along the axial direction A from a forward end 86 to an aft end 88. Inner liner 82 generally defines a hot side 90 exposed to and defining in part a portion of the hot gas path 78 extending through the combustion chamber 80. Inner liner 82 further defines a cold side 92 opposite hot side 90. Similarly, outer liner 84 also defines a hot side 94 exposed to and defining in part a portion of the hot gas path 78 extending through the combustion chamber 80, and outer liner 84 further defines a cold side 96 opposite hot side 94.

The inner and outer liners 82, 84 are each attached to an annular dome 100 at the forward end 86 of combustor assembly 79. More particularly, dome 100 includes an inner dome section 102 attached to inner liner 82 and an outer dome section 104 attached to outer liner 84. The inner and outer dome sections 102, 104 may each extend along a circumferential direction C (FIG. 3) to define an annular shape. Inner and outer dome sections 102, 104 each also define a slot 106 for receipt of inner liner 82 and outer liner 84, respectively.

Combustor assembly 79 further includes a plurality of fuel air mixers 108 spaced along the circumferential direction and positioned at least partially within the dome 100. More particularly, the plurality of fuel air mixers 108 are disposed at least partially between outer dome section 104 and inner dome section 102 along the radial direction R. Compressed air from the compressor section of the turbofan engine 10 flows into or through the fuel air mixers 108, where the compressed air is mixed with fuel and ignited to create the combustion gases 66 within the combustion chamber 80. The inner and outer dome sections 102, 104 are configured to assist in providing the flow of compressed air from the compressor section into or through the fuel air mixers 108. For example, inner dome section 102 includes an inner cowl 110, and outer dome section 104 similarly includes an outer cowl 112. The inner and outer cowls 110, 112 may assist in directing the flow of compressed air from the compressor section into or through one or more of the fuel air mixers 108.

In certain exemplary embodiments, the inner dome section 102 with inner cowl 110 may be formed integrally as a single annular component, and similarly, the outer dome section 104 with outer cowl 112 also may be formed integrally as a single annular component. It should be appreciated, however, that in other exemplary embodiments, the inner dome section 102 and/or the outer dome section 104 alternatively may be formed by one or more components being joined in any suitable manner. For example, with reference to the outer dome section 104, in certain exemplary embodiments, outer cowl 112 may be formed separately from outer dome section 104 and attached to outer dome section 104 using, e.g., a welding process. Additionally or alternatively, the inner dome section 102 may have a similar configuration.

Referring still to FIG. 2, the exemplary combustor assembly 79 further includes a heat shield 114 positioned around the fuel air mixer 108 as depicted. The exemplary heat shield 114, for the depicted embodiment, is attached to and extends between inner and outer dome sections 102, 104. The heat shield 114 is configured to protect certain components of the turbofan engine 10 from the relatively extreme temperatures of the combustion chamber 80, as described in greater detail below.

Keeping with FIG. 2, combustor assembly 79 at the aft end 88 includes an inner piston ring seal 116 at inner liner 82 and an outer piston ring seal 118 at outer liner 84. The inner piston ring seal 116 is attached to an inner piston ring holder 120 extending from and attached to an inner casing 122. Similarly, the outer piston ring seal 118 is attached to an outer piston ring holder 124 extending from and attached to an outer casing 126. Inner piston ring holder 120 and outer piston ring holder 124 are configured to accommodate an expansion of the inner liner 82 and the outer liner 84 generally along the axial direction A, as well as generally along the radial direction R. To allow for a relative thermal expansion between the outer liner 84 and the outer dome section 104, as well as between the inner liner 82 and the inner dome section 102, a plurality of mounting assemblies 130 are used to attach outer liner 84 to outer dome section 104 and inner liner 82 to inner dome section 104. More particularly, the mounting assemblies 130 attach the forward end of outer liner 84 to outer dome section 104 within the slot 106 of outer dome section 104 and the forward end of inner liner 82 to inner dome section 102 within the slot 122 of inner dome section 102.

Further, as is discussed above, the combustion gases 66 flow from the combustion chamber 80 into and through the turbine section of the turbofan engine 12, where a portion of thermal and/or kinetic energy from the combustion gases 66 is extracted via sequential stages of turbine stator vanes and turbine rotor blades. A stage one (1) stator vane 128 is depicted schematically in FIG. 2, aft of the combustor assembly 79.

In some embodiments, components of turbofan engine 10, particularly components within hot gas path 78 such as components of combustion assembly 79, may comprise a ceramic matrix composite (CMC) material, which is a non-metallic material having high temperature capability. Exemplary CMC materials utilized for such components may include silicon carbide (SiC), silicon, silica, or alumina matrix materials and combinations thereof. Ceramic fibers may be embedded within the matrix, such as oxidation stable reinforcing fibers including monofilaments like sapphire and silicon carbide (e.g., Textron's SCS-6), as well as rovings and yarn including silicon carbide (e.g., Nippon Carbon's NICALON®, Ube Industries' TYRANNO®, and Dow Corning's SYLRAMIC®), alumina silicates (e.g., Nextel's 440 and 480), and chopped whiskers and fibers (e.g., Nextel's 440 and SAFFIL®), and optionally ceramic particles (e.g., oxides of Si, Al, Zr, Y, and combinations thereof) and inorganic fillers (e.g., pyrophyllite, wollastonite, mica, talc, kyanite, and montmorillonite). For example, in certain embodiments, bundles of the fibers, which may include a ceramic refractory material coating, are formed as a reinforced tape, such as a unidirectional reinforced tape. A plurality of the tapes may be laid up together (e.g., as plies) to form a preform component. The bundles of fibers may be impregnated with a slurry composition prior to forming the preform or after formation of the preform. The preform may then undergo thermal processing, such as a cure or burn-out to yield a high char residue in the preform, and subsequent chemical processing, such as melt-infiltration with silicon, to arrive at a component formed of a CMC material having a desired chemical composition. In other embodiments, the CMC material may be formed as, e.g., a carbon fiber cloth rather than as a tape.

As stated, components comprising a CMC material may be used within the hot gas path 78, such as within the combustion and/or turbine sections of engine 10. However, CMC components may be used in other sections as well, such as the compressor and/or fan sections. As a particular example described in greater detail below, heat shield 114 for combustor dome 100 may be formed from a CMC material to provide protection to the dome from the heat of the combustion gases, e.g., without requiring cooling from a flow of fluid as is usually required for metal heat shields.

Figure 3:
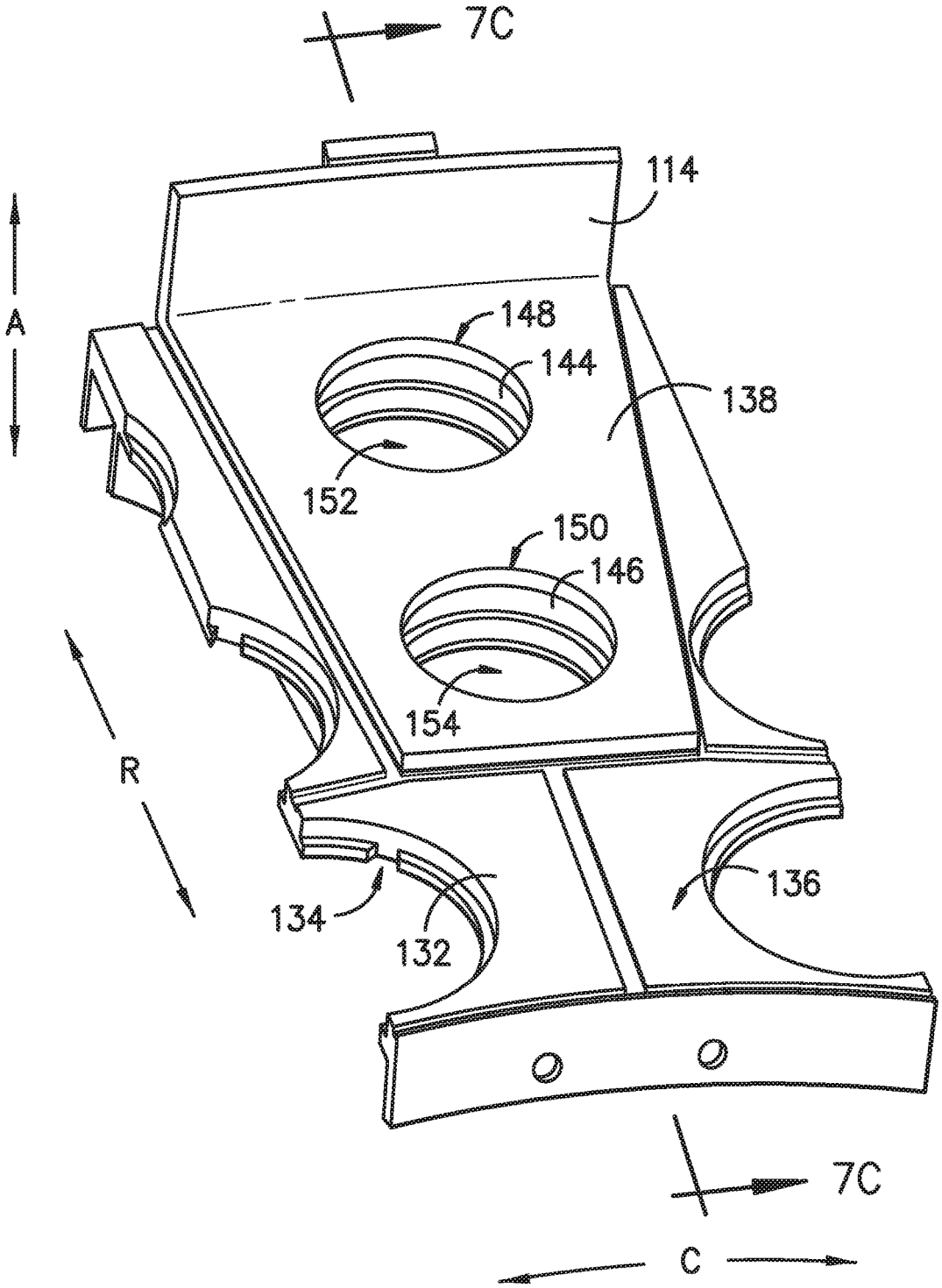
FIG. 3 provides an aft perspective view of a portion of the combustor assembly of FIG. 2, according to an exemplary embodiment of the present subject matter.

Turning now to FIG. 3, an aft side perspective view is provided of a heat shield 114 and a portion of a dome plate 132 of combustor assembly 79, according to an exemplary embodiment of the present subject matter. In various embodiments, dome plate 132 may include at least a portion of inner dome segment 102, at least a portion of outer dome segment 104, or at least a portion of both inner and outer dome segments 102, 104. In some embodiments, dome plate 132 may comprise the entire dome 100. Other configurations of dome plate 132 may be used as well.

As illustrated in FIG. 3, the dome plate 132 includes a forward side 134 and an aft side 136, and heat shield 114 is attached to dome plate 132 such that a plate portion 138 of heat shield 114 is positioned on the aft side 136 of dome plate 132. Dome plate 132 defines a first aperture 140 (FIG. 4) and a second aperture 142 (FIG. 4), and heat shield 114 includes a first cup 144 and a second cup 146. As shown, the first cup 144 extends toward the first aperture 140 of dome plate 132. Similarly, second cup 146 extends toward the second aperture 142 of dome plate 132. Moreover, heat shield 114 defines a first opening 148 and a second opening 150. The first opening 148 is defined at least in part by first cup 144 and the second opening 150 is defined at least in part by second cup 146. As such, first opening 148, first cup 144, and first aperture 140 define a first passage 152 through heat shield 114 and dome plate 132. Similarly, second opening 150, second cup 146, and second aperture 142 define a second passage 154 through heat shield 114 and dome plate 132.

Figure 4:
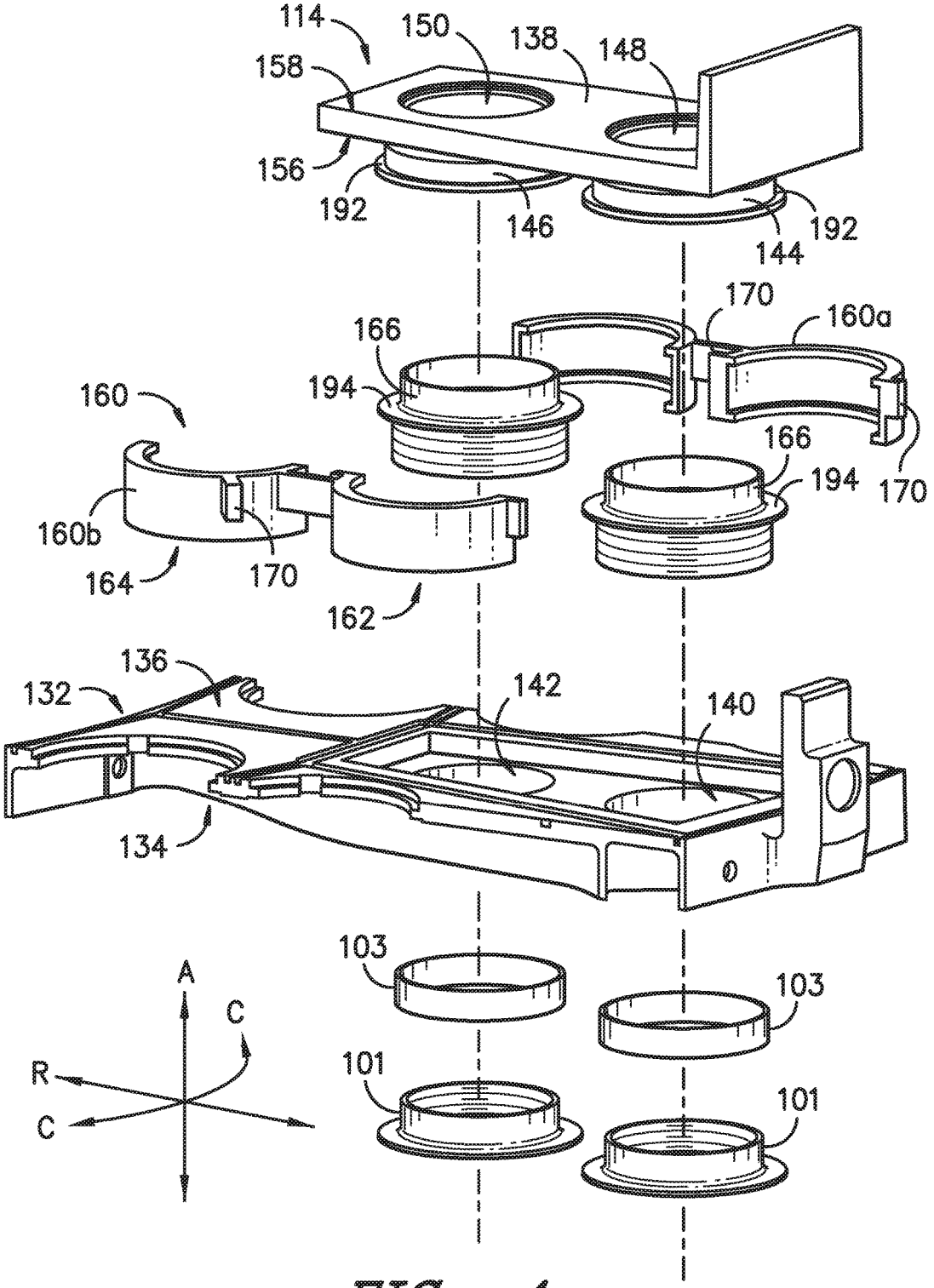
FIG. 4 provides an exploded view of the portion of the combustor assembly of FIG. 3.

Referring now to FIG. 4, an exploded view is provided of heat shield 114, dome plate 132, and means for attaching the heat shield to the dome plate, according to an exemplary embodiment of the present subject matter. More particularly, heat shield 114 includes a forward surface 156 and an aft surface 158. The forward surface 156 and aft surface 158 each define in part the first and second openings 148, 150 in heat shield 114. Further, as shown in FIG. 4, first cup 144 extends from the forward surface 156, as well as extends about the first opening 148. Similarly, second cup 146 extends from the forward surface 156, as well as extends about the second opening 150. Although first and second cups 144, 146 generally are annular in the depicted embodiment, in other embodiments first and second cups 144, 146 may have another suitable shape.

Figure 5:
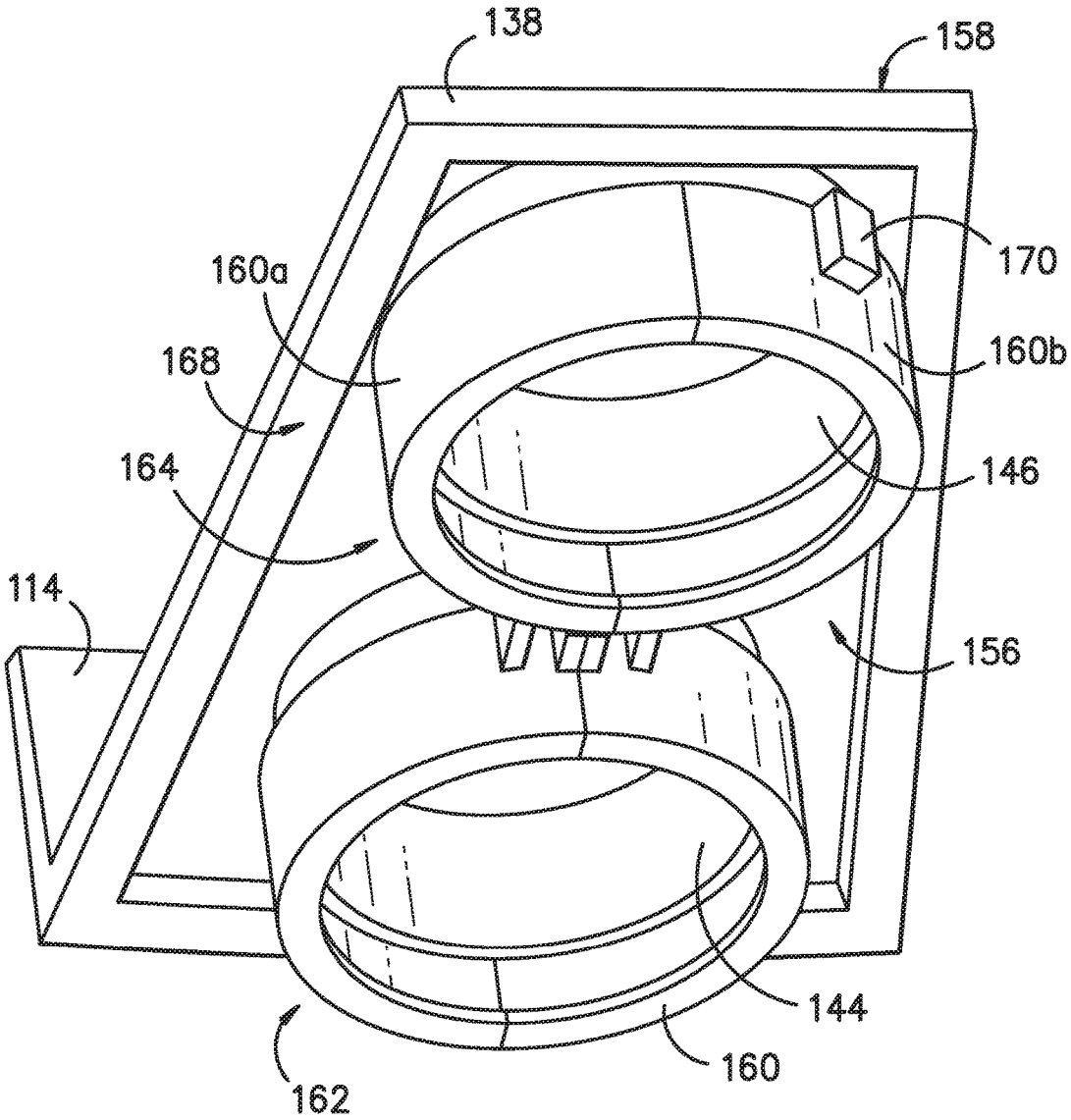
FIG. 5 provides a forward perspective view of a heat shield and a collar of the portion of the combustor assembly of FIG. 3, according to an exemplary embodiment of the present subject matter.

Keeping with FIG. 4, the combustor assembly 79 further includes a collar 160 that is attachable to the heat shield 114 for coupling the heat shield 114 to the dome plate 132. Collar 160 includes a first frame 162 and a second frame 164. Turning to FIG. 5, when assembled with heat shield 114, the first frame 162 extends about an outer perimeter of the first cup 144 such that the first frame 162 at least partially surrounds the first cup 144. Likewise, the second frame 164 extends about an outer perimeter of the second cup 146 such that the second frame 164 at least partially surrounds the second cup 146. As depicted in FIGS. 4 and 5, collar 160 is split into two halves along a collar centerline $CL_1$ (FIGS. 6A and 7A) that extends generally along the radial direction R. Further, each of the first frame 162 and second frame 164 is generally annular or ring-shaped. As such, the depicted collar 160 may be described as a split-ring collar. A first half 160*a* of the split-ring collar 160 may include a first portion 162*a* of the first frame 162 and a first portion 164*a* of the second frame 164, while a second half 160*b* of the split-ring collar 160 may include a second portion 162*b* of the first frame 162 and a second portion 164*b* of the second frame 164.

As illustrated in FIG. 4, an attachment piece 166 may be included to help couple heat shield 114 to dome plate 132. As most clearly shown in FIGS. 6C and 8B and described in greater detail below, collar 160 may couple attachment piece 166 to heat shield 114, and as shown in FIG. 4, attachment piece 166 may be threaded to engage threads of a nut 101 or another suitable component and thereby couple heat shield 114 to dome plate 132 of combustor dome 100. For example, as described below with respect to FIG. 10, the threads of attachment piece 166 may engage the threads of retainer nut 101 that, together with a spacer 103, secures attachment piece 166 within a bore of combustor dome 100. Of course, in other embodiments, attachment piece 166 may have other configurations or features to help attach heat shield 114 to dome plate 132.

FIG. 5 depicts an aft perspective view of heat shield 114 and collar 160 according to an exemplary embodiment of the present subject matter. As shown in FIG. 5, a pad 168 is defined along a perimeter of forward surface 156 of the plate portion 138 of heat shield 114. The pad 168 along the perimeter may, e.g., provide a target area for the placement of a seal member 190 (FIGS. 6C, 8B) between heat shield 114 and dome plate 132, e.g., to provide a seal between the heat shield and the dome plate. More particularly, the raised pad 168 preferably is dimensioned to reduce or relax a locational tolerance required for any seal member placed about the perimeter of heat shield 114. That is, pad 168 may be sized such that a tight or close tolerance is not required for the placement of a seal member about the perimeter of heat shield 114. In one embodiment, the seal member 190 may be a spline seal that is used along pad 168 to provide a seal between heat shield 114 and dome plate 132. In other embodiments, other types and/or configurations of seal member 190 may be used.

Figure 6B:
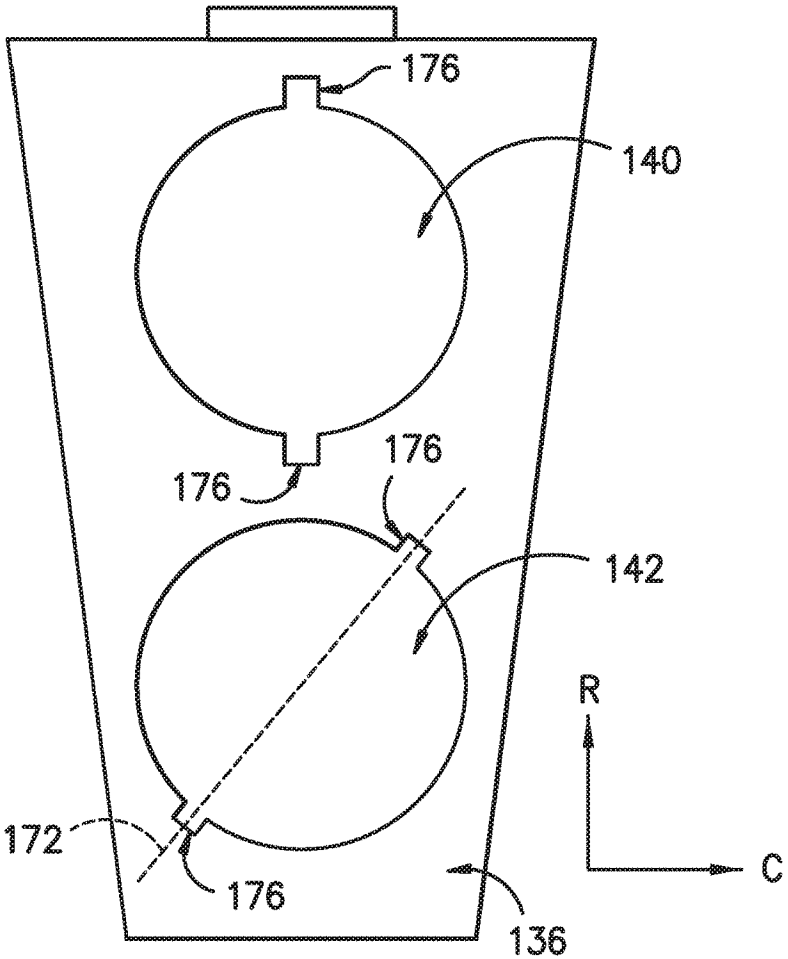
FIG. 6B provides a schematic view of a dome plate according to an exemplary embodiment of the present subject matter.
Figure 6A:
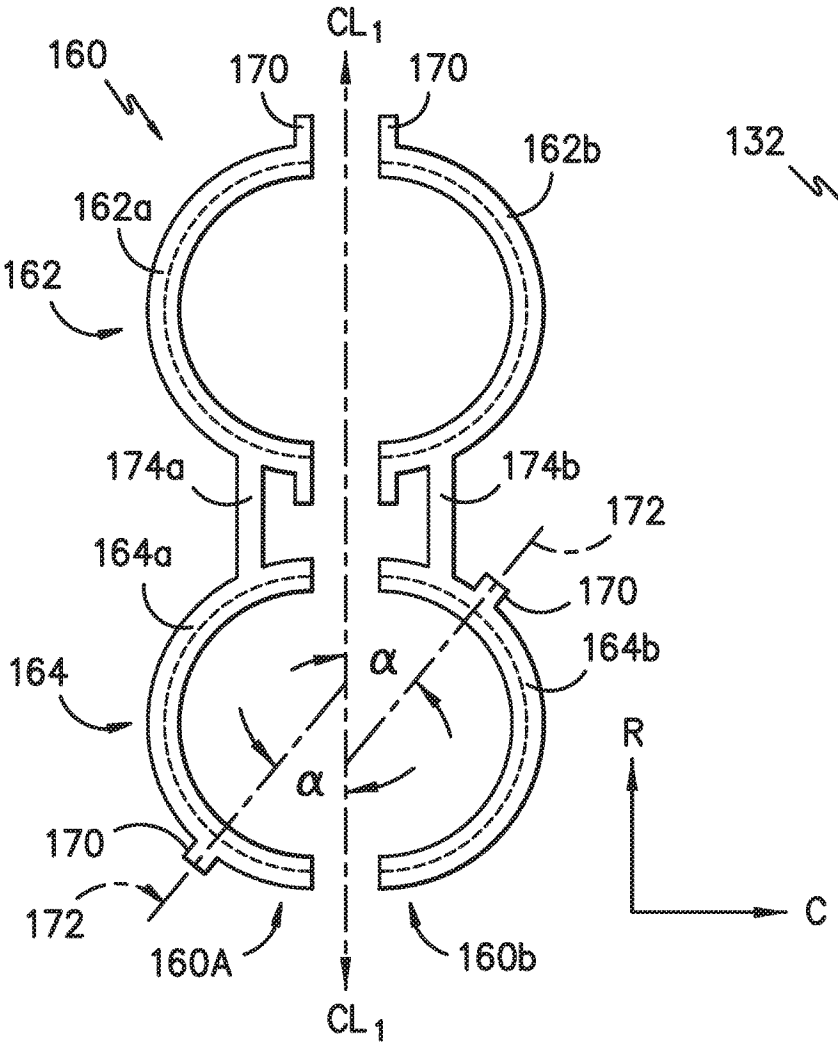
FIG. 6A provides a schematic view of the collar of FIG. 5 according to an exemplary embodiment of the present subject matter.

Turning now to FIGS. 6A and 6B, aft side views are provided of split-ring collar 160 (FIG. 6A) and dome plate 132 (FIG. 6B) according to an exemplary embodiment of the present subject matter. As shown in FIG. 6A, each of first portion 162*a* of first frame 162, second portion 162*b* of first frame 162, first portion 164*a* of second frame 164, and second portion 164*b* of second frame 164 includes at least one fastening feature 170. More particularly, in the embodiment depicted in FIG. 6A, each of the fastening features 170 of first frame 162 and second frame 164 are tabs, which, as described in greater detail below, are configured to mate with corresponding grooves defined in dome plate 132 to couple the heat shield to the dome plate. The tabs 170 may be defined at different positions along the respective frame 162, 164, and some frame portions may include more than one tab 170. For example, in the embodiment of FIG. 6A, first and second portions 162*a*, 162*b* of first frame 162 each include two tabs 170, and each tab 170 extends outwardly from first frame 162 generally along or parallel to the collar centerline $CL_1$ and the radial direction R. In contrast, first and second frame portions 164*a*, 164*b* of second frame 164 each define one tab 170, and the tabs 170 of second frame 164 extend outwardly from second frame 164, generally at a non-orthogonal angle $\alpha$ with respect to the collar centerline $CL_1$ and the radial direction R. More specifically, tabs 170 of second frame 164 generally extend in a direction of a straight line 172 drawn through both tabs 170, where the line 172 is at the non-orthogonal angle $\alpha$ with respect to the collar centerline $CL_1$ and the radial direction R.

As further shown in FIG. 6A, each collar half 160*a*, 160*b* includes a bridge member 174. First bridge member 174*a* helps connect the first portion 162*a* of first frame 162 with the first portion 164*a* of second frame 164, and second bridge member 174*b* helps connect the second portion 162*b* of first frame 162 with the second portion 164*b* of second frame 164. As will be discussed in greater detail below, bridge members 174 may act as springs in collar 160, e.g., to help hold the collar's position with respect to dome plate 132, and therefore the position of heat shield 114 with respect to dome plate 132, as the temperatures within combustor 79 increase and the components undergo thermal expansion.

Referring to FIG. 6B, the dome plate 132 includes at least one fastening feature 176 that is complementary to fastening feature 170 of collar 160. More particularly, in the embodiment of FIG. 6B, the fastening features 176 are grooves defined in dome plate 132 adjacent first and second apertures 140, 142. Each groove fastening feature 176 is configured to receive at least one tab 170 of collar 160 to help couple heat shield 114 to dome plate 132. For example, in the depicted embodiment of FIG. 6B, two grooves 176 are defined in the dome plate 132 adjacent first aperture 140 such that the grooves 176 open into the first aperture 140. The grooves 176 in dome plate 132 at first aperture 140 correspond to the tabs 170 included on first frame 162 of collar 160. As such, the grooves 176 at first aperture 140 are defined substantially along the radial direction R, and when collar 160 is received within dome plate 132, the tabs 170 of first frame 162 are received within the grooves 176 adjacent first aperture 140. Similarly, two grooves 176 are defined in the dome plate 132 adjacent second aperture 142 such that the grooves 176 open into the second aperture 142. The grooves 176 in dome plate 132 at second aperture 142 correspond to the tabs 170 included on second frame 164 of collar 160. Accordingly, the grooves 176 at second aperture 142 are defined at the non-orthogonal angle $\alpha$ with respect to the radial direction R. As such, when collar 160 is received within dome plate 132, the tabs 170 of second frame 164 are received within the grooves 176 adjacent second aperture 142, and a straight line 178 drawn through both grooves 176 defined at second aperture 142 is substantially parallel to straight line 172 drawn through tabs 170 of second frame 164 of collar 160.

The fastening features 170 of collar 160 and fastening features 176 of dome plate 132 thereby provide essentially anti-rotation fastening between the heat shield 114 and dome plate 132 while also accounting for different coefficients of thermal expansion between the heat shield material and the dome plate material. That is, heat shield 114 preferably is fabricated from a CMC material as discussed above and as further described below, and the dome plate 132 and collar 160 each may be made from a metallic material, such as a metal alloy. In such embodiments, there is an alpha mismatch between heat shield 114, dome plate 132, and collar 160, i.e., the coefficient of thermal expansion of the CMC heat shield is different from the coefficient of thermal expansion of the metallic dome plate and the metallic collar. Generally, in such embodiments, the dome plate 132 will expand at lower temperatures than the CMC heat shield 114. The grooves 176, i.e., the fastening features of dome plate 132, may be set or defined in the direction of growth of dome plate 132. More particularly, the first and second apertures 140, 142 of dome plate 132 may grow, or thermally expand, in the same direction or in different directions. Therefore, the grooves 176 may be defined at different locations with respect to the apertures 140, 142 as shown in FIGS. 4 and 6B, or in other embodiments, may be defined at substantially the same location with respect to each aperture 140, 142. The tabs 170 of collar 160 are positioned with respect to first and second frames 162, 164 to correspond to the respective grooves 176 of dome plate 132, as previously described. Then, when collar 160 is assembled with heat shield 114 and the collar and heat shield assembly is received within dome plate 132, the tabs 170 mate with the grooves 176 to attach the heat shield 114 such that the first and second cups 144, 146 and heat shield 114 do not rotate with respect to dome plate 132, or vice versa. Further, it will be appreciated that, as the combustion temperatures rise and the components experience thermal expansion, the collar 160 may grow with dome plate 132 such that tabs 170 remain within groove 176 to maintain the relative positions of the heat shield 114 and dome plate 132.

Figure 6C:
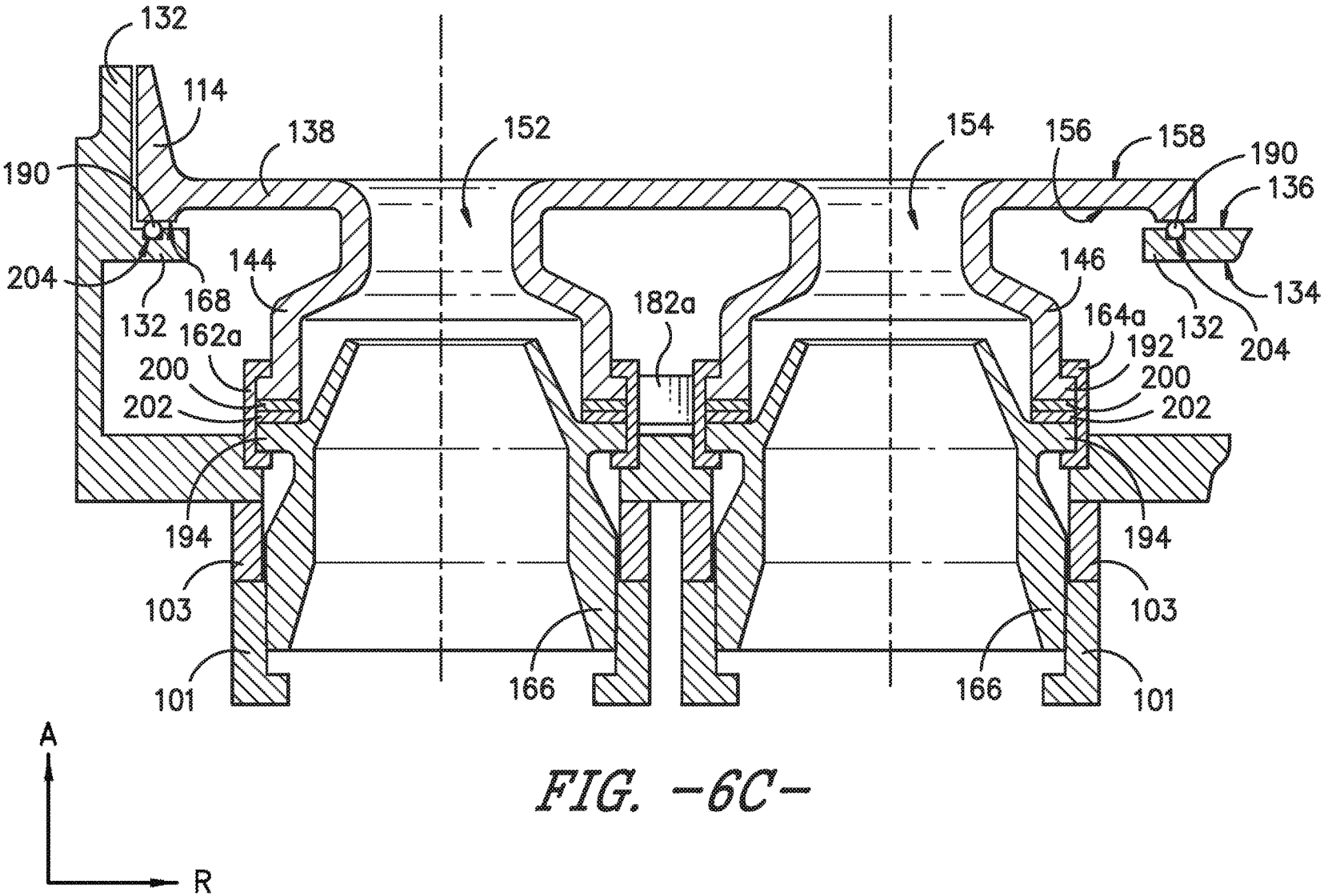
FIG. 6C provides a cross-section view of the portion of the combustor assembly of FIG. 3 having a collar as in FIG. 6A and a dome plate as in FIG. 6B, according to an exemplary embodiment of the present subject matter.

Referring to FIG. 6C, a cross-section view is provided of a heat shield and dome plate assembly according to an exemplary embodiment of the present subject matter. As illustrated, the collar 160 is received within the first aperture 140 and the second aperture 142 of the dome plate 132 such that the collar expands and contracts within the dome plate 132 with thermal changes in the combustor assembly 79. That is, as temperatures increase within combustor assembly 79, the collar 160 thermally expands within dome plate 132, and as temperatures subsequently decrease within combustor assembly 79, the collar 160 thermally contracts within dome plate 132. As described above, the first and second fastening features, such as tabs 170 of collar 160 and grooves 176 of dome plate 132, mate to help prevent rotational and/or other movement of collar 160 relative to the dome plate 132 as the components of combustor assembly 79 thermally expand and contract, which helps keep the heat shield 114 in place with respect to dome plate 132. However, it will be understood that the configuration of collar 160 and heat shield 114, e.g., the first and second frames 162, 164 of collar 160 fitting around first and second cups 144, 146 of heat shield 114, allows or compensates for differences in thermal expansion between the collar and heat shield, as well as differences in thermal expansion between the heat shield and combustor dome 100.

Moreover, as previously stated, an attachment piece 166 may be used at each cup 144, 146 of heat shield 114 to help couple heat shield 114 to dome plate 132. In the exemplary embodiment shown in FIG. 6C, first cup 144 includes a flange 192 that extends about the outer perimeter of the cup. Attachment piece 166 also includes a flange 194 extending about an outer perimeter of the attachment piece at an aft end thereof. First frame 162 of collar 160 has a generally C- or U-shaped cross-section such that first frame fits over both the first cup flange 192 and attachment piece flange 194 to couple the attachment piece 166 to heat shield 114. One or more seals and/or washers, such as a flat washer 200 and a wave seal 202 as depicted in FIG. 6C, may be included between the first cup flange 192 and attachment piece flange 194. The seals and/or washers may, e.g., compensate for variations in part dimensions and/or differences in thermal expansion between the CMC heat shield 114 and metallic collar 160 and attachment piece 166 and thereby help mitigate wear between heat shield 114 and attachment piece 166 and/or help prevent hot gas leakage between heat shield 114 and attachment piece 166, as hot gas leakage could decrease the effectiveness of the heat shield in protecting dome plate 132 from exposure to the hot combustion gases. As previously described, at least a portion of attachment piece 166, such as a portion of an outer surface of the attachment piece, may be threaded to engage with threads defined in dome plate 132 (or to engage threads of a feature such as retainer nut 101) and thereby help couple the heat shield 114 to dome plate 132 of combustor dome 100.

As further illustrated in FIG. 6C, one heat shield 114 may be positioned adjacent another heat shield 114. That is, in some embodiments, multiple heat shields may be used to protect dome 100 from hot combustion gases generated within combustor 79. At the interface between adjacent heat shields 114, a seal member 190 may be used to provide a seal between the heat shields 114 and dome plate 132 and, e.g., to prevent hot gas leakage at the interface between the heat shields. In the exemplary embodiment of FIG. 6C, a seal member 190 is received within a recess 204 defined in dome plate 132 and seals against pad 168 extending about the edge of a heat shield 114. Thus, at least one seal member 190 is provided at the edge of each heat shield 114 such that two seal members 190 may be adjacent one another at the interface between adjacent heat shields 114. It will be understood that other types and configurations of seal members 190 may be used as well.

Further, it will be appreciated that, although described above with respect to only first cup 144 of heat shield 114 and first frame 162 of collar 160, as illustrated in FIG. 6C, second cup 146 and second frame 164 may be configured similarly to first cup 144 and first frame 162, respectively, and a second attachment piece 166 coupled with second cup 146 to help attach heat shield 114 to dome plate 132. More particularly, second cup 146 may include a flange 192 that extends about the outer perimeter of the cup, and the second attachment piece 166 may also include a flange 194 extending about an outer perimeter of the attachment piece at an aft end thereof. Second frame 164 of collar 160 may have a generally C- or U-shaped cross-section such that the second frame 164 fits over both the second cup flange 192 and the second attachment piece flange 194 to couple the second attachment piece 166 to heat shield 114. Moreover, one or more seals and/or washers, such as a flat washer 200 and a wave seal 202, may be included between the second cup flange 192 and second attachment piece flange 194, e.g., to compensate for variations in part dimensions and/or differences in thermal expansion between the CMC heat shield 114 and metallic collar 160 and second attachment piece 166, which can help mitigate wear between heat shield 114 and second attachment piece 166 and/or help prevent hot gas leakage between heat shield 114 and second attachment piece 166. At least a portion of the second attachment piece 166, such as a portion of an outer surface of the attachment piece, may be threaded to engage with threads defined in dome plate 132 (or to engage threads of a feature such as retainer nut 101) and thereby help couple the heat shield 114 to dome plate 132 of combustor dome 100.

Figure 7B:
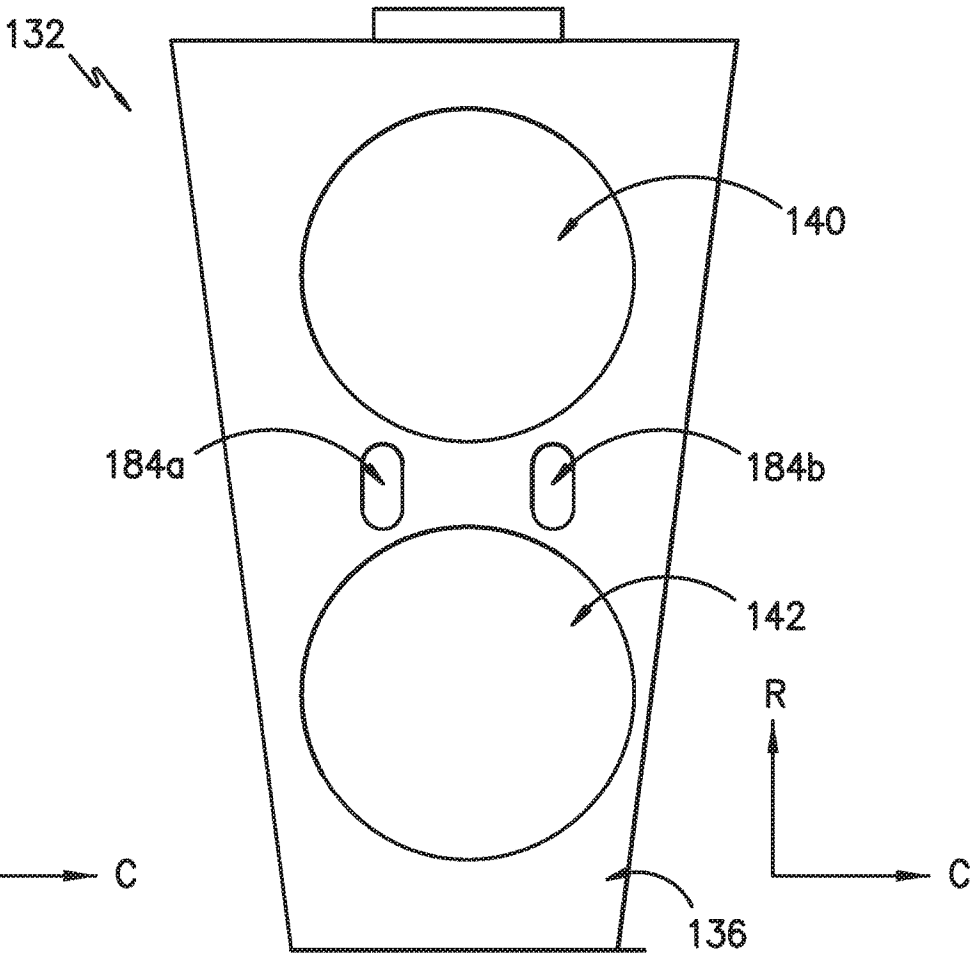
FIG. 7B provides a schematic view of a dome plate according to another exemplary embodiment of the present subject matter.
Figure 7A:
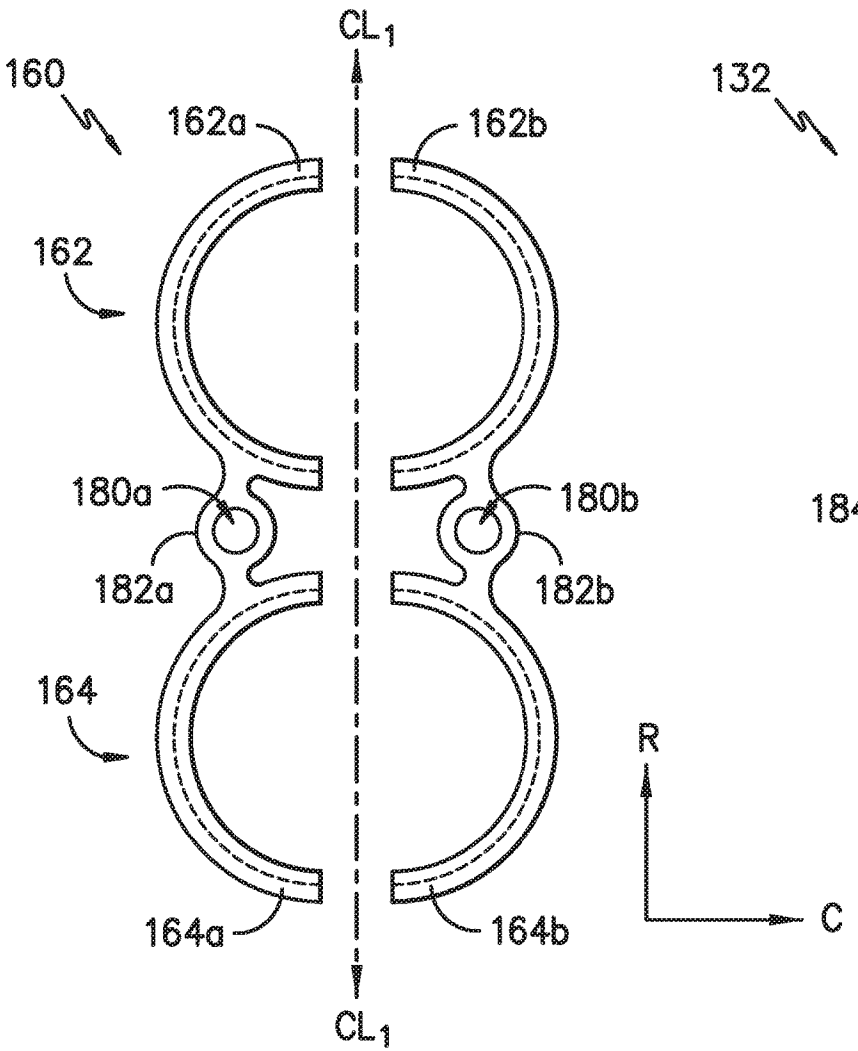
FIG. 7A provides a schematic view of a collar according to another exemplary embodiment of the present subject matter.

Turning now to FIGS. 7A and 7B, an aft side view is provided of collar 160 (FIG. 7A) and dome plate 132 (FIG. 7B) according to another exemplary embodiment of the present subject matter. As illustrated in FIG. 7A, in some embodiments bridge members 174, rather than first and/or second frames 162, 164, may define one or more fastening features to help couple heat shield 114 to dome plate 132. More specifically, in the illustrated embodiment, each bridge member 174 defines a pin aperture 180, i.e., bridge member 174*a* of first half 160*a* defines a pin aperture 180*a* and bridge member 174*b* of second half 160*b* defines a pin aperture 180*b*. As such, the pin apertures 180*a*, 180*b* are defined between the first frame 162 and the second frame 164 along the radial direction R. Further, in the depicted embodiment bridge members 174*a*, 174*b* each include a generally annular or ring-shaped portion 182 that defines pin apertures 180*a*, 180*b*. First bridge member 174*a* includes a first annular portion 182*a* that defines first pin aperture 180*a*, and second bridge member 174*b* includes a second annular portion 182*b* that defines second pin aperture 180*b*. However, in other embodiments, bridge members 174*a*, 174*b* may have other shapes or configurations and may define pin apertures 180 in any suitable portion of the respective bridge member. In still other embodiments, pins apertures 180 may be defined by other suitable portions collar 160 than bridge members 174.

Referring to FIG. 7B, in some embodiments, the dome plate 132 defines one or more fastening features between the first aperture 140 and second aperture 142. The exemplary dome plate 132 depicted in FIG. 7B defines two slots 184 between first aperture 140 and second aperture 142, a first slot 184*a* and a second slot 184*b*. The slots 184 are spaced from first and second apertures 140, 142 along the radial direction R and from one another along the circumferential direction C. As shown, the slots 184 are elongated, or generally pill-shaped, along the radial direction R.

When the collar 160 as shown in FIG. 7A is assembled with heat shield 114 and the dome plate 132 as shown in FIG. 7B, the slots 184 of the dome plate 132 align with pin apertures 180 of collar 160 such that a pin (not shown) may be received within both the slots 184 and the pin apertures 180 to help couple the heat shield to the dome plate. More particularly, a pin is received with both first slot 184*a* and first pin aperture 180*a*, which is defined by first annular portion 182*a*. It will be understood that a second pin may be similarly received within second slot 184*b* and second pin aperture 180*b*. In appropriate embodiments, only one pin aperture 180, slot 184, and pin may be used, or in other embodiments, more than two pin apertures 180, slots 184, and pins may be used. In any event, the pin and slot fastening features of collar 160 and dome plate 132 can help couple heat shield 114 (to which collar 160 is attached) to dome plate 132, or at least help heat shield 114 and dome plate 132 maintain their relative positions with respect to one another. More specifically, a pin is received in slot(s) 184 and pin aperture(s) 180 to mate the fastening feature of collar 160 (i.e., pin aperture 180) with the fastening feature of dome plate 132 (i.e., slot 184) to help couple the heat shield 114 and dome plate 132 and/or to help maintain the relative positions of heat shield 114 and dome plate 132.

Further, it will be appreciated that slots 184 may be located to minimize the impacts of an alpha mismatch, i.e., a mismatch of coefficients of thermal expansion, between the heat shield 114 and dome plate 132. That is, slots 184 may be defined in an area of dome plate 132 that is the relatively coolest area of the dome plate to minimize the thermal changes in the slot dimensions, which may impact the relative positions of the heat shield 114 and dome plate 132 with respect to one another. As such, the slots 184 may be defined in dome plate 132 to minimize the changes in position of heat shield 114 and dome plate 132 in the direction of growth of the dome plate.

Figure 8A:
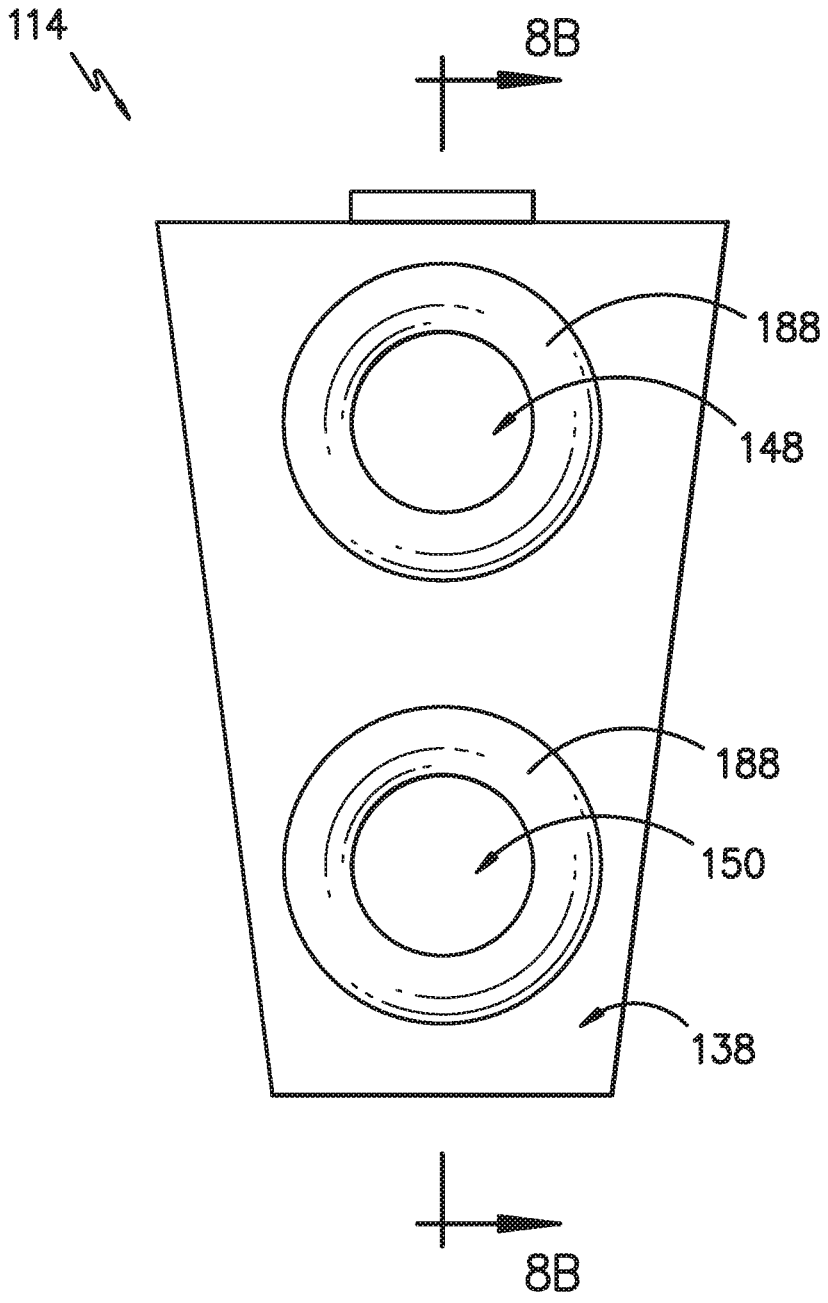
FIG. 8A provides a schematic view of a combustor heat shield according to another exemplary embodiment of the present subject matter.
Figure 8B:
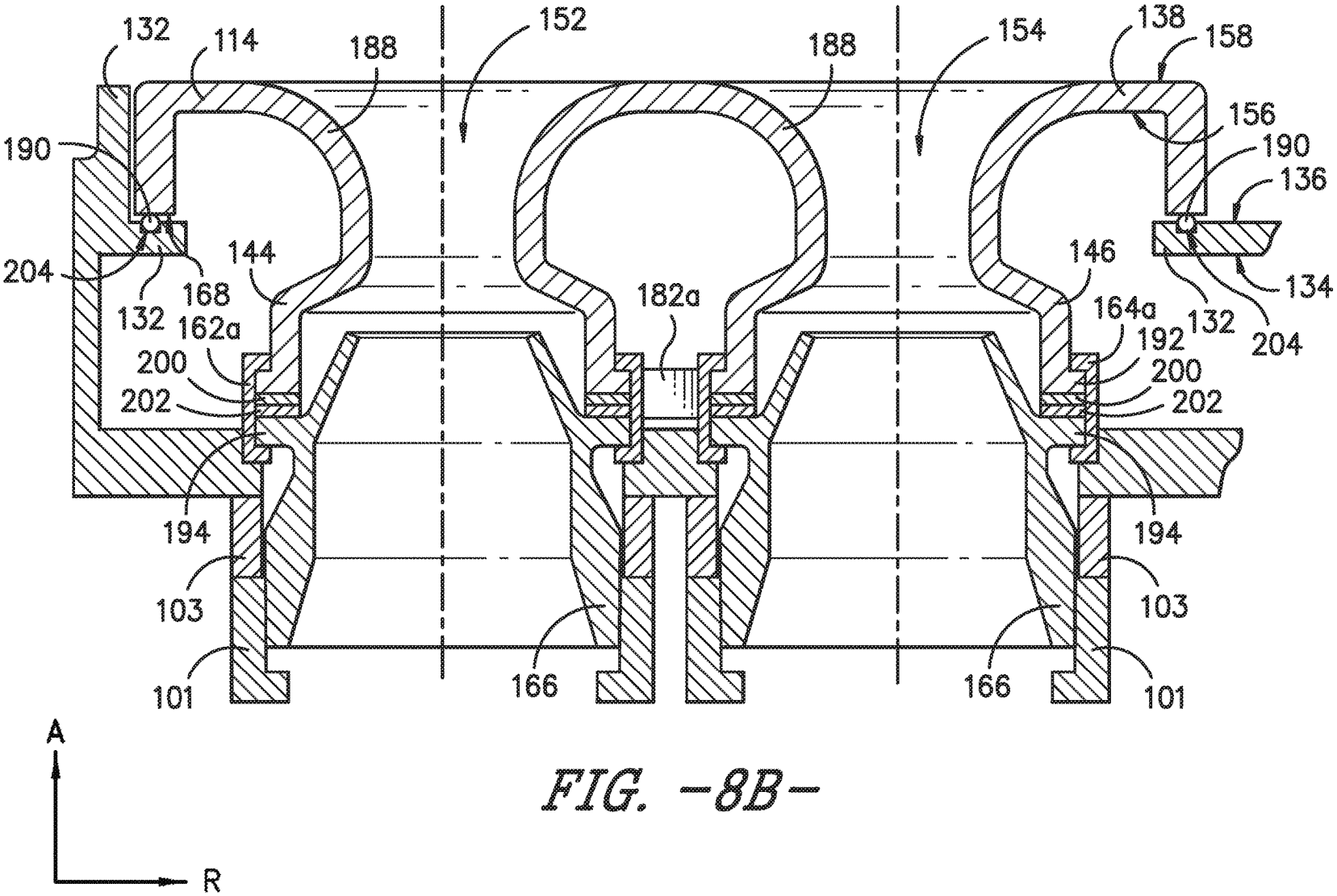
FIG. 8B provides a cross-section view of the portion of the combustor assembly of FIG. 3 having a collar as in FIG. 6A and a heat shield as in FIG. 8A, according to an exemplary embodiment of the present subject matter.

Turning now to FIGS. 8A and 8B, an aft side view (FIG. 8A) and a cross-section view (FIG. 8B) are provided of heat shield 114 according to another exemplary embodiment of the present subject matter. As illustrated in FIGS. 8A and 8B, plate portion 138 of heat shield may have a generally conical shape about first and second openings 148, 150. Stated differently, in some embodiments, the plate portion 138 around first opening 148 and second opening 150 may project away from dome plate 132 to define generally conical or funnel-shaped areas 188 around first and second openings 148, 150 opposite first and second cups 144, 146. Similar attachment features as described above with respect to FIGS. 6A and 6B or 7A-7C may be used to couple heat shield 114 having conical areas 188 to dome plate 132.

Figure 9:
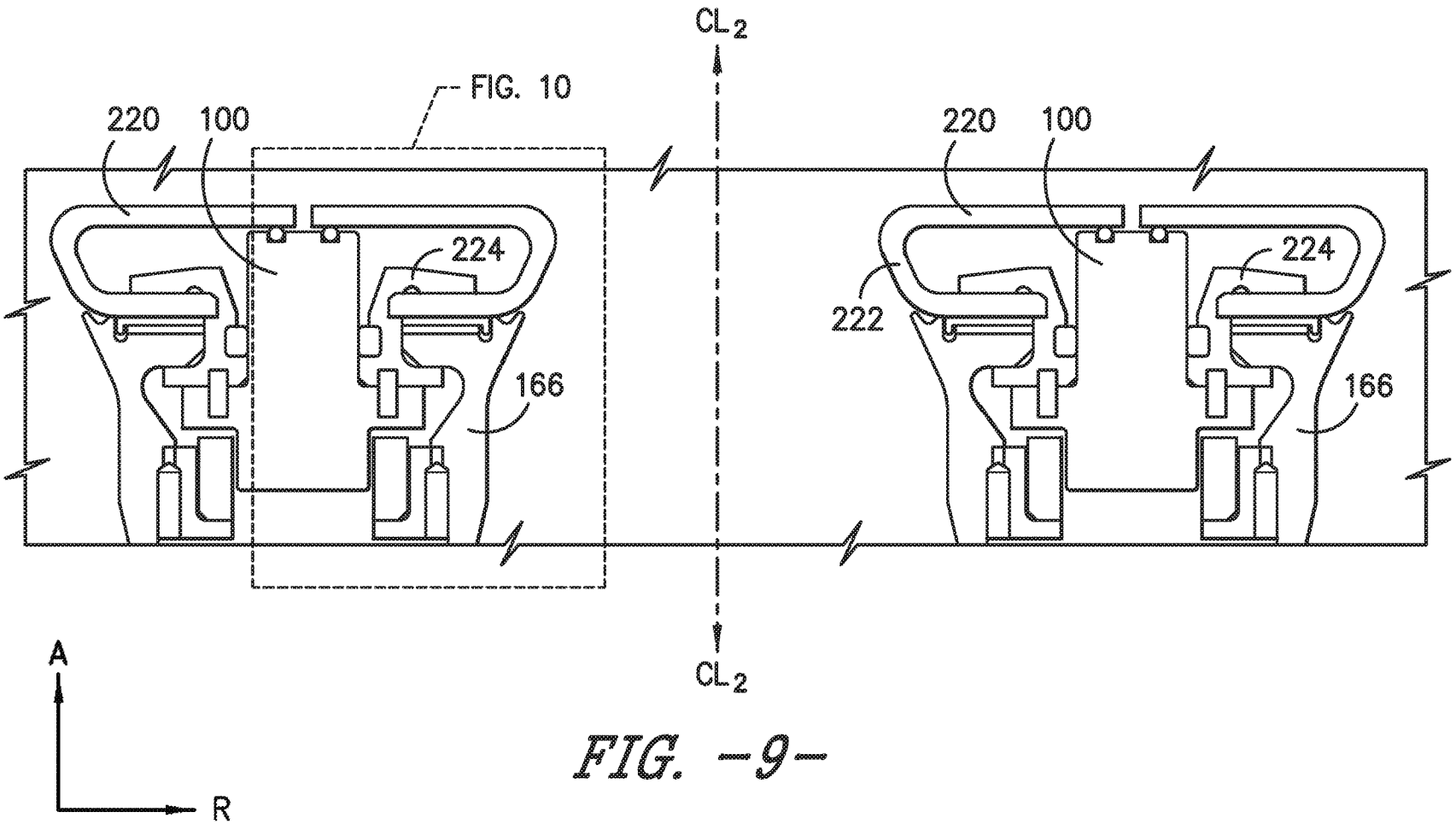
FIG. 9 provides a schematic cross-section view of a portion of the combustor assembly of FIG. 3 according to another exemplary embodiment of the present subject matter.
Figure 10:
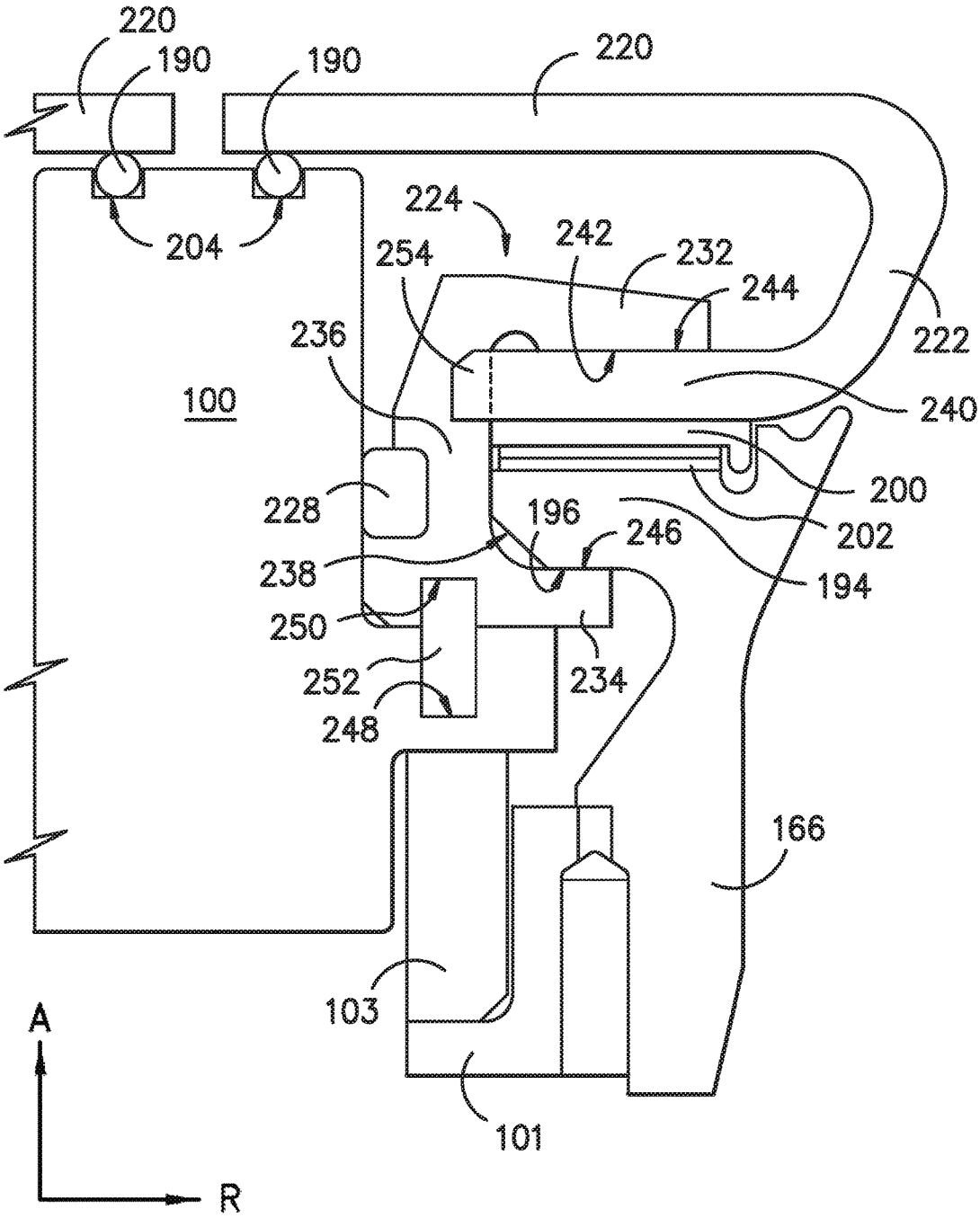
FIG. 10 provides a close-up view of a portion of the combustor assembly shown in FIG. 9.

Turning now to FIGS. 9 and 10, another embodiment of a combustor assembly according to the present subject matter is illustrated. As shown schematically in FIG. 9, in some embodiments, the combustor assembly may include a heat shield 220 comprising a single cup 222 that defines a cup centerline $CL_2$ extending generally along or parallel to the axial direction A. That is, a single cup heat shield 220, rather than heat shield 114 having multiple cups such as first and second cups 144, 146 described above, may be used with combustor dome 100. In such embodiments, a collar 224 having a single frame may used with each cup 222 of heat shield 220 rather than a collar 160 having multiple frames such as frames 162, 164 previously described. Additionally or alternatively, a single frame collar 224 may be used with each cup of a multi-cup heat shield 114, e.g., rather than a multi-frame collar 160.

Similar to collar 160 described above, collar 224 is attachable to the heat shield 220 for coupling the heat shield 220 to the combustor dome 100. Collar 224 includes a first half or piece 224*a* and a second half or piece 224*b*. When assembled with heat shield 220, the first piece 224*a* extends about a portion of the cup 222 defined by heat shield 220 such that the first piece 224*a* partially surrounds the cup 222. Likewise, the second piece 224*b* extends about the remaining portion of cup 222 such that the second piece 224*b* partially surrounds the cup 222. In exemplary embodiments, collar 224 is split into the two halves 224*a*, 224*b* along a collar centerline, and the collar 224 is generally annular or ring-shaped such that each half 224*a*, 224*b* is generally a half ring shape or extends in a 180° arc. In other embodiments, the collar 224 may be split into unequal pieces, e.g., one piece 224*a* or 224*b* may extend in an arc of more than 180° while the other piece 224*a* or 224*b* extends in an arc of less than 180°. In still other embodiments, the collar 224 may be split into more than two pieces, e.g., three generally wedge or pie-shaped pieces or the like. In any event, like collar 160, because collar 224 is split such that it is not a single piece collar, the collar 224 may be described as a split-ring collar.

Figure 11:
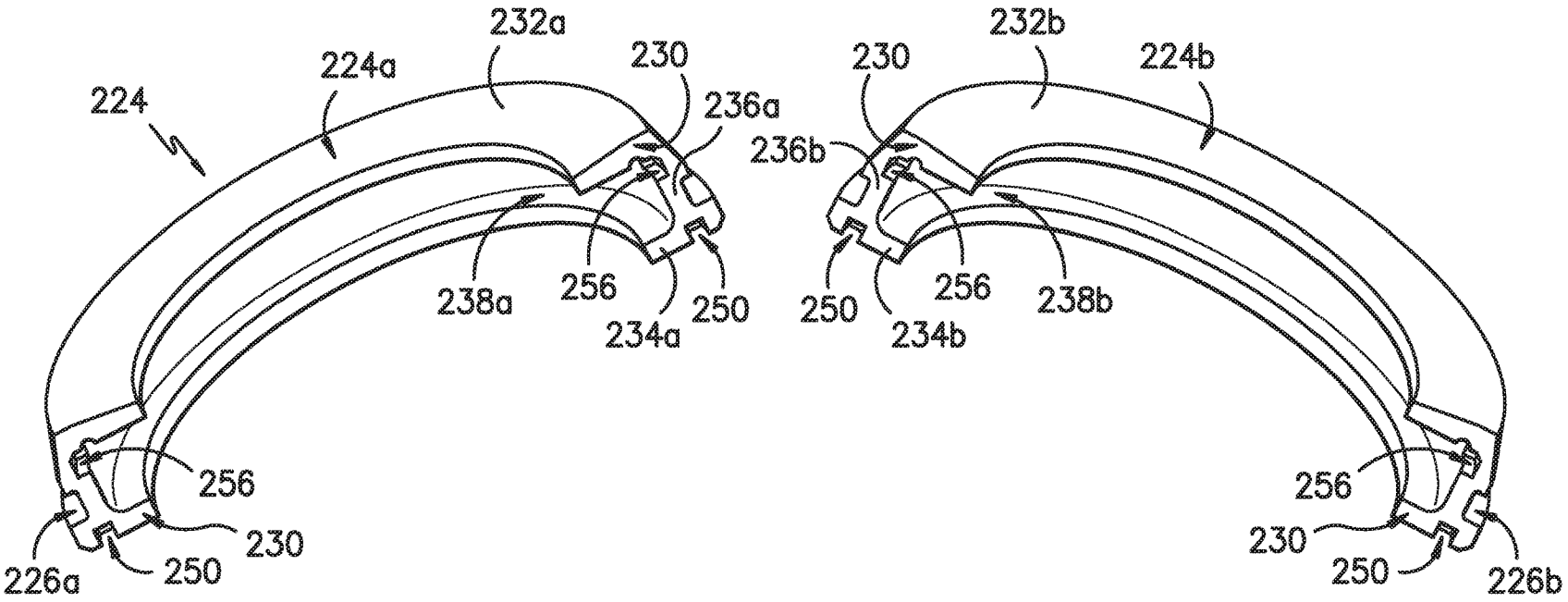
FIG. 11 provides a perspective view of a collar according to another exemplary embodiment of the present subject matter.

Referring particularly to FIGS. 10 and 11, FIG. 10 provides a close-up view of a portion of the combustor assembly of FIG. 9, and FIG. 11 provides a perspective view of collar 224 in which the first piece 224*a* is separated from the second piece 224*b*. As illustrated, collar 224 defines a groove 226 about its outer perimeter such that first piece 224*a* defines a first portion 226*a* of the groove and second piece 224*b* defines a second portion 226*b* of the groove. A snap ring 228 is positioned within the groove portions 226*a*, 226*b* forming groove 226 such that the snap ring 228 spans an interface 230 between the collar pieces 224*a*, 224*b*. The snap ring 228 may be a constricting snap ring for holding the collar pieces 224*a*, 224*b* together, particularly as the collar 224 is installed in the combustor assembly. Of course, in some embodiments, the collar 224 may be a non-round or non-annular shape such that the snap ring 228 has a non-ring shape but still serves to hold together the first and second pieces 224*a*, 224*b* of collar 224.

As shown in FIG. 10, collar 224 has a generally C- or U-shaped cross-section. More particularly, collar 224 includes a first arm 232, a second arm 234, and a body 236 that connects the first arm 232 and the second arm 234. As depicted in FIG. 10, the first arm 232, second arm 234, and body 236 define the generally C- or U-shaped cross-section of collar 224. Further, body 236 connects first and second arms 232, 234 such that the collar 224 defines a recess 238 between the first arm 232 and the second arm 234.

It will be appreciated that, because the first piece 224*a* comprises one piece of collar 224 and the second piece 224*b* comprises the second piece of collar 224, each piece 224*a*, 224*b* includes a portion of the first arm 232, a portion of the second arm 234, and a portion of the body 236 such that each piece 224*a*, 224*b* defines a portion of the recess 238 between the first and second arms 232, 234. More specifically, as shown in most clearly in FIG. 11, first piece 224*a* of collar 224 includes a first piece 232*a* of first arm 232, a first piece 234*a* of second arm 234, a first piece 236*a* of body 236, and a first piece 238*a* of recess 238. Similarly, second piece 224*b* of collar 224 includes a second piece 232*b* of first arm 232, a second piece 234*b* of second arm 234, a second piece 236*b* of body 236, and a second piece 238*b* of recess 238.

As illustrated in FIGS. 9 and 10, an attachment piece 166 may be included to help couple the heat shield 220 to combustor dome 100. As previously described, attachment piece 166 may be threaded to engage threads defined in the combustor dome 100, or in a retainer nut 101 that, together with a spacer 103, interfaces with dome 100, and thereby couple heat shield 220 to the combustor dome 100. Of course, in other embodiments, attachment piece 166 may have other configurations or features to help attach heat shield 220 to combustor dome 100.

Referring particularly to FIG. 10, the heat shield 220 defines a heat shield flange 240 around an outer perimeter of the cup 222, and the attachment piece 166 defines an attachment flange 194, as described above. Collar 224 fits around both the heat shield flange 240 and attachment flange 194 to couple the attachment piece 166 to heat shield 220.

That is, heat shield flange 240 and attachment piece flange 194 are positioned within recess 238 of collar 224 to couple the heat shield 220 and the attachment piece 166. The first arm 232 of collar 224 defines a first mating surface 242 that contacts a heat shield mating surface 244 defined by heat shield flange 240. Similarly, the second arm 234 of collar 224 defines a second mating surface 246 that contacts an attachment mating surface 196 defined by attachment piece 166. One or more seals and/or washers, such as a flat washer 200 and a wave seal 202 described above with respect to FIG. 6C, may be included within recess 238, e.g., between the heat shield flange 240 and attachment piece flange 194 such that the seals and/or washers help to hold heat shield mating surface 244 against first mating surface 242 of collar 224 and to hold attachment mating surface 196 against second mating surface 246 of collar 224, which can help prevent hot gas leakage between the heat shield 220 and attachment piece 166. Additionally or alternatively, the seals and/or washers may help mitigate wear between heat shield 220 and attachment piece 166 and/or may otherwise provide a seal to help prevent hot gas leakage between heat shield 220 and attachment piece 166. The leakage of hot gas between the heat shield 220 and attachment piece 166 could decrease the effectiveness of the heat shield in protecting combustor dome 100 from exposure to the hot combustion gases. Moreover, the seals and/or washers included within recess 238 also may compensate for variations in part dimensions and/or differences in thermal expansion between collar 224 and heat shield 220 and attachment piece 166, e.g., to help to hold heat shield mating surface 244 against first mating surface 242 of collar 224 and to help to hold attachment mating surface 196 against second mating surface 246 of collar 224.

Further, as previously described, at least a portion of attachment piece 166, such as a portion of an outer surface of the attachment piece, may be threaded to help couple the heat shield 220 to combustor dome 100. For example, the threads of the attachment piece 166 may threadingly engage combustor dome 100 directly or, as shown in FIGS. 9 and 10, may threadingly engage one or more components such as retainer nut 101 and spacer 103 that attach the attachment piece 166 to the dome 100. Of course, attachment piece 166 may attach to combustor dome 100 in other ways as well.

The combustor assembly also may include one or more features for keeping its components properly oriented with respect to one another. For example, the heat shield 220 preferably is a CMC component, and collar 224, attachment piece 166, and combustor dome 100 may be metallic components. As such, the rates of thermal expansion may vary between the components, particularly between the CMC component and the metallic components, such that the components may shift and/or rotate with respect to one another as the temperature of the combustion assembly increases. Accordingly, the combustor assembly may include features for maintaining the components oriented with respect to one another.

For example, as most clearly shown in FIG. 10, the combustor dome 100 defines a dome pocket 248 and the collar 224 defines a collar pocket 250. The collar pocket 250 aligns with the dome pocket 248 such that a pin 252 may be positioned within the dome pocket 248 and collar pocket 250 to hold the collar 224, and thereby heat shield 220, in position with respect to combustor dome 100. More specifically, a portion of pin 252 is positioned in the dome pocket 248 and a remaining portion of pin 252 is received in the collar pocket 250 such that pin 252 is positioned within both pockets 248, 250. It will be appreciated that pockets 248, 250 may be defined in any appropriate locations within combustor dome 100 and collar 224, respectively, and may be of any suitable size and shape. Further, some embodiments of the combustor assembly may define more than one dome pocket 248 and more than one collar pocket 250 such that multiple pin and pocket features are utilized to orient the collar 224 with respect to the combustor dome 100. Thus, the pocket features 248, 250 together with pin 252 may be included in the combustor assembly for keeping heat shield 220 and combustor dome 100 properly oriented with respect to one another. As discussed above, such features may be particularly useful for embodiments in which the heat shield 220 is made from a CMC material and combustor dome 100 is made from a metallic material such that the heat shield and dome have different coefficients of thermal expansion and thermally expand at different rates.

As another example, referring to FIGS. 10 and 11, the heat shield flange 240 may include a projection 254 extending toward the collar 224, and the collar 224 may define a slot 256 for receipt of the projection 254. In some embodiments, the heat shield flange 240 may include a tab-like projection at one or more locations about its outer perimeter or rim, and the collar 224 may define one or more slots 256, wherein each slot 256 is configured to receive a projection 254 of the heat shield flange 240. The heat shield flange projection 254 and collar slot 256 may be included at any suitable location of flange 240 and collar 224, respectively. In an exemplary embodiment, the collar 224 may define slot 256 such that a portion of slot 256 is defined by the first piece 224*a* of collar 224 and a remaining portion of slot 256 is defined by the second piece 224*b* of collar 224. Thus, the heat shield flange 240 may define a projection 254 such that when the projection 254 is received within the slot 256, the projection spans the interface 230 between the first and second pieces 224*a*, 224*b* of collar 224. Additionally or alternatively, each piece 224*a*, 224*b* of collar 224 may fully, rather than partially, define a slot 256 that receives a projection 254 of heat shield flange 240. It will be understood that collar 224 and heat shield 220 may define any appropriate number of slots 256 and projections 254, respectively, such that the heat shield 220 and collar 224 may each include one or more features for keeping the heat shield and collar properly oriented with respect to one another. As previously stated, such features may be particularly beneficial in embodiments in which the heat shield 220 is made from a CMC material and collar 224 is made from a metallic material such that the heat shield and collar have different coefficients of thermal expansion and thermally expand at different rates.

Although described with respect to a single or individual heat shield cup 222, it will be appreciated that the description of the combustor assembly depicted in FIGS. 9 through 11 also may apply to multi-cup heat shield designs utilizing collars having multiple rings or frames. For example, in some embodiments, a double split-ring collar may be used that has one or more collar pockets, and the combustor dome may define one or more dome pockets, such that a pin may be partially received in each dome pocket and the remainder of each pin received in a corresponding collar pocket to help hold the collar in position with respect to the combustor dome.

Figure 12:
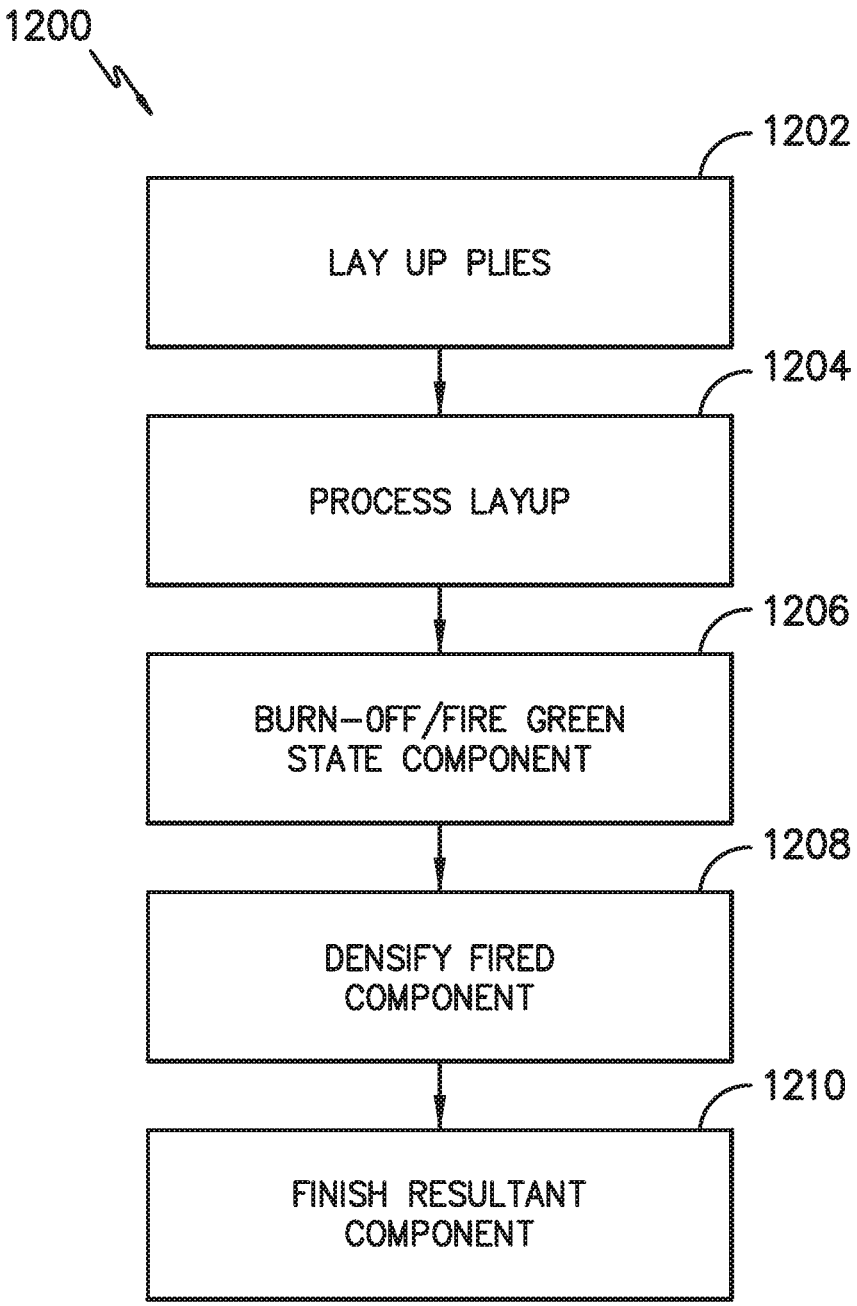
FIG. 12 provides a chart illustrating a method for forming a ceramic matrix composite heat shield according to an exemplary embodiment of the present subject matter.

FIG. 12 provides a flow diagram illustrating a method 1200 for forming a CMC component, such as a CMC heat shield, according to an exemplary embodiment of the present subject matter. As previously described, heat shield 114 may be made from a CMC material, which is a non-metallic material having high temperature capability. As such, CMC materials may be beneficial for use in forming parts of combustor assembly 79, e.g., heat shield 114, that are exposed to the hot combustion gases. However, although method 1300 is described below with respect to forming a CMC heat shield 114, it will be appreciated that method 1300 may be applicable to forming other components of combustor assembly 79 and turbofan engine 10.

As shown at 1202 in FIG. 12, a plurality of plies of a CMC material for forming the CMC component may be laid up to form a CMC component preform having a desired shape or contour. It will be appreciated that the plurality of CMC plies forming the preform may be laid up on a layup tool, mold, mandrel, or another appropriate device for supporting the plies and/or for defining the desired shape. The desired shape of CMC component preform may be a desired shape or contour of the resultant CMC component. As an example, the plies may be laid up to define a shape of CMC component preform that is the shape of heat shield 114, such as the heat shield shown in FIG. 4 or in FIG. 8B, or heat shield 220 shown in FIGS. 9 and 10. In one embodiment, laying up the plurality of plies may include stacking plies to define pad 168 about a perimeter of the heat shield preform, such that the pad 168 comprises a stack of plies of the CMC material. Laying up the plurality of plies also may include defining a flange 192 extending about first cup 144 and second cup 146. Laying up the plurality of plies to form the heat shield preform may include defining other features of heat shield 114 as well, or may include defining features of heat shield 220 such as cup 222 having flange 240.

The exemplary double cup heat shields 114 described above define a relatively large area for positioning a perimeter seal and with relatively simple features for coupling the heat shields to a combustor dome. Therefore, the plurality of plies of CMC material for forming such heat shields 114 may have more reasonable or less complex ply shapes than known or former heat shield configurations, which may simplify the layup process and thereby simplify the fabrication of CMC heat shields 114. Similarly, the exemplary single cup heat shields 220 also may have simpler or less complex shapes and attachment features than known single cup or other heat shield designs, which may simplify the layup process and thereby simplify the fabrication of CMC heat shields 220.

After the plurality of plies is laid up, the plies may be processed, e.g., compacted and cured in an autoclave, as shown at 1204 in FIG. 12. After processing, the plies form a green state CMC component, e.g., a green state CMC heat shield 114 or a green state heat shield 220. The green state CMC component is a single piece component, i.e., curing the plurality of plies joins the plies to produce a CMC component formed from a continuous piece of CMC material. The green state component then may undergo firing (or burn-off) and densification, illustrated at 1206 and 1208 in FIG. 12, to produce a final CMC component. In an exemplary embodiment of method 1200, the green state component is placed in a furnace with silicon to burn off any mandrel-forming materials and/or solvents used in forming the CMC plies, to decompose binders in the solvents, and to convert a ceramic matrix precursor of the plies into the ceramic material of the matrix of the CMC component. The silicon melts and infiltrates any porosity created with the matrix as a result of the decomposition of the binder during burn-off/firing; the melt infiltration of the CMC component with silicon densifies the CMC component. However, densification may be performed using any known densification technique including, but not limited to, Silcomp, melt-infiltration (MI), chemical vapor infiltration (CVI), polymer infiltration and pyrolysis (PIP), and oxide/oxide processes. In one embodiment, densification and firing may be conducted in a vacuum furnace or an inert atmosphere having an established atmosphere at temperatures above 1300° C. to allow silicon or another appropriate material or materials to melt-infiltrate into the component. Optionally, as shown at 1210 in FIG. 12, after firing and densification the CMC component may be finish machined, if and as needed, and/or coated with an environmental barrier coating (EBC).

Method 1200 is provided by way of example only. For example, other processing cycles, e.g., utilizing other known methods or techniques for compacting and/or curing CMC plies, may be used. Further, the CMC component may be post-processed or densified using any appropriate means. Alternatively, any combinations of these or other known processes may be used as well.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A combustor assembly for a gas turbine engine, comprising:

a combustor dome defining an aperture and a dome pocket;

a heat shield defining an opening and including a cup extending about the opening, the cup extending toward the aperture of the combustor dome; and a collar defining a collar pocket and comprising a first piece and a second piece, each of the first piece and the second piece surrounding a portion of the cup, wherein a portion of a pin is positioned in the dome pocket and a remaining portion of the pin is received in the collar pocket.

2. The combustor assembly of claim 1, wherein the collar comprises a first arm, a second arm, and a body connecting the first arm and the second arm such that the collar defines a recess between the first arm and the second arm, wherein each piece of the collar includes a portion of the first arm, a portion of the second arm, and a portion of the body such that each of the first piece and the second piece of the collar defines a portion of the recess between the first arm and the second arm.

3. The combustor assembly of claim 2, wherein the heat shield includes a heat shield flange extending outwardly from an outer perimeter of the cup, and wherein a portion of the heat shield flange is positioned within the portion of the recess defined by the first piece of the collar and a remaining portion of the heat shield flange is positioned within the portion of the recess defined by the second piece of the collar.

4. The combustor assembly of claim 3, further comprising an attachment piece defining an opening therethrough, the attachment piece including an attachment flange extending outwardly from an outer perimeter of the attachment piece, and wherein a portion of the attachment flange is positioned within the portion of the recess defined by the first piece of the collar and a remaining portion of the attachment flange is positioned within the portion of the recess defined by the second piece of the collar.

5. The combustor assembly of claim 1, wherein each of the first piece and the second piece of the collar surrounds a portion of the cup to allow the collar and the heat shield to expand at different thermal rates.

6. The combustor assembly of claim 1, wherein each of the first piece and the second piece of the collar defines a groove, and wherein a snap ring is positioned within the grooves such that the snap ring spans an interface between each of the first piece and the second piece of the collar.

7. The combustor assembly of claim 1, wherein the heat shield includes a heat shield flange extending outwardly from an outer perimeter of the cup, wherein the heat shield flange includes a projection extending toward the collar, and wherein the collar defines a slot for receipt of the projection.

8. A combustor assembly for a gas turbine engine, comprising:

a combustor dome defining an aperture;

a heat shield defining an opening and including a cup extending about the opening, the cup extending toward the aperture of the combustor dome, the heat shield including a heat shield flange extending outwardly from an outer perimeter of the cup; and a collar including a first arm, a second arm, and a body connecting the first arm and the second arm such that the collar defines a recess between the first arm and the second arm, wherein the heat shield flange is positioned within the recess, wherein the heat shield flange includes a projection extending toward the collar, and wherein the collar defines a slot for receipt of the projection.

9. The combustor assembly of claim 8, wherein the collar comprises a first piece and a second piece, each of the first piece and the second piece including a portion of the first arm, a portion of the second arm, and a portion of the body such that each of the first piece and the second piece defines a portion of the recess between the first arm and the second arm.

10. The combustor assembly of claim 9, wherein each of the first piece and the second piece of the collar defines a groove, and wherein a snap ring is positioned within the grooves such that the snap ring spans an interface between the collar pieces.

11. The combustor assembly of claim 8, further comprising an attachment piece defining an opening therethrough, the attachment piece including an attachment flange extending outwardly from an outer perimeter of the attachment piece, and wherein the attachment flange is positioned within the recess.

12. The combustor assembly of claim 8, wherein the combustor dome defines a dome pocket and the collar defines a collar pocket, wherein a portion of a pin is positioned in the dome pocket and a remaining portion of the pin is received in the collar pocket.

13. A combustor assembly for a gas turbine engine, comprising:

a combustor dome defining an aperture;

a heat shield defining an opening and including a cup extending about the opening, the cup extending toward the aperture of the combustor dome, the heat shield including a heat shield flange extending outwardly from an outer perimeter of the cup;

an attachment piece defining an opening therethrough, the attachment piece including an attachment flange extending outwardly from an outer perimeter of the attachment piece; and a collar surrounding the heat shield flange and the attachment flange to couple the heat shield and the attachment piece, wherein the attachment piece attaches to the combustor dome to couple the heat shield and the combustor dome, wherein the heat shield flange includes a projection extending toward the collar, and wherein the collar defines a slot for receipt of the projection.

14. The combustor assembly of claim 13, wherein the collar includes a first arm, a second arm, and a body connecting the first arm and the second arm such that the collar defines a recess between the first arm and the second arm, wherein the heat shield flange and the attachment flange are positioned within the recess such that the collar surrounds the heat shield flange and the attachment piece flange.

15. The combustor assembly of claim 14, wherein the collar comprises a first piece and a second piece, each of the first piece and the second piece including a portion of the first arm, a portion of the second arm, and a portion of the body such that each of the first piece and the second piece defines a portion of the recess between the first arm and the second arm.

16. The combustor assembly of claim 15, wherein each of the first piece and the second piece of the collar defines a groove, and wherein a snap ring is positioned within the grooves such that the snap ring spans an interface between each of the first piece and the second the collar.

17. The combustor assembly of claim 13, wherein the combustor dome defines a dome pocket and the collar defines a collar pocket, wherein a portion of a pin is positioned in the dome pocket and a remaining portion of the pin is received in the collar pocket.

* * * * *